US009861538B2

(12) United States Patent
Krolick et al.

(10) Patent No.: US 9,861,538 B2
(45) **Date of Patent: *Jan. 9, 2018**

(54) EMERGENCY LIFT AND TRANSPORT SYSTEM

(71) Applicants: Robert S Krolick, Roseville, CA (US); Sanford Shapiro, San Rafael, CA (US); Duane Carling, Farmington, UT (US)

(72) Inventors: Robert S Krolick, Roseville, CA (US); Sanford Shapiro, San Rafael, CA (US); Duane Carling, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/442,919

(22) Filed: Feb. 27, 2017

(65) Prior Publication Data

US 2017/0165135 A1 Jun. 15, 2017

Related U.S. Application Data

(63) Continuation-in-part of application No. 14/741,299, filed on Jun. 16, 2015, now Pat. No. 9,579,240.

(51) Int. Cl.

| | |
|---|---|
| ***A61G 1/003*** | (2006.01) |
| ***A61G 1/056*** | (2006.01) |
| ***A61G 7/012*** | (2006.01) |
| ***A47C 19/04*** | (2006.01) |
| ***A61G 1/06*** | (2006.01) |

(52) U.S. Cl.

CPC ..... *A61G 1/003* (2013.01); *A47C 19/045* (2013.01); *A61G 1/06* (2013.01); *A61G 1/0565* (2013.01); *A61G 7/012* (2013.01)

(58) Field of Classification Search

CPC .... A47C 19/045; A61G 1/013; A61G 1/0212; A61G 1/0565; A61G 7/012; A61G 13/06; A61G 1/003; A61G 1/04; A61G 1/06; B66F 3/28; B66F 5/04; B66F 7/08

See application file for complete search history.

(56) References Cited

U.S. PATENT DOCUMENTS

| | | | | |
|---|---|---|---|---|
| 2,202,383 A | | 12/1937 | Hymer et al. | |
| 2,747,919 A | * | 5/1956 | Ferneau | A61G 1/0237 280/43.13 |
| 3,901,356 A | * | 8/1975 | Butler | B66F 7/065 187/211 |
| 4,549,720 A | * | 10/1985 | Bergenwall | A47B 9/16 187/269 |
| 4,987,620 A | | 1/1991 | Sharon | |
| 6,336,235 B1 | | 1/2002 | Ruehl | |

(Continued)

FOREIGN PATENT DOCUMENTS

| | | | | |
|---|---|---|---|---|
| EP | 2494889 A1 | * | 9/2012 | A47C 19/045 |
| WO | WO-9705925 A1 | * | 2/1997 | A61G 13/009 |

*Primary Examiner* — Nicholas F Polito

(74) *Attorney, Agent, or Firm* — Steven A. Nielsen; www.NielsenPatents.com

(57) ABSTRACT

A mechanical lift features the low profile of a traditional wood and cloth cot stretcher allowing patients to be easily rolled or moved upon a flat surface. An integrated mechanical lift system then lifts a patient to a raised position without need for manual lifting. The lift allows patients to be moved and transported without back strain to health care workers or first responders. The lift may be raised by the mechanical movement or expansion of a piston.

8 Claims, 37 Drawing Sheets

(56) References Cited

U.S. PATENT DOCUMENTS

| | | | | |
|---|---|---|---|---|
| 6,381,781 | B1 | 5/2002 | Bourgraf et al. | |
| 6,389,623 | B1 | 5/2002 | Flynn et al. | |
| 6,799,770 | B2 | 10/2004 | Patrick et al. | |
| 7,757,313 | B2 * | 7/2010 | Koorey | A47C 19/045 5/11 |
| 8,739,329 | B2 * | 6/2014 | Koorey | A47C 19/045 5/11 |
| 9,579,240 | B2 * | 2/2017 | Krolick | A61G 1/017 |
| 2004/0187213 | A1 * | 9/2004 | Wang | A61G 7/012 5/618 |
| 2015/0359693 | A1 * | 12/2015 | Lyon | A61G 7/015 5/610 |

* cited by examiner

EMERGENCY LIFT AND TRANSPORT SYSTEM

RELATED PATENT APPLICATION AND INCORPORATION BY REFERENCE

This utility patent application is a continuation-in-part of U.S. patent application Ser. No. 14/741,299 filed on Jun. 16, 2015. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to low profile stretchers that rise in a horizontal position. More particularly, the invention relates to the use of unique rotational and sliding components that are inwardly layered to create a low profile lift that moves a patient from the floor to a raised position with a single powered movement.

(2) Description of the Related Art

In the related art, health care workers and first responders face the dilemma of moving a patient from the ground to a raised position. Such workers often suffer significant injuries in manually lifting a patient off of the ground. A traditional folding cot stretcher having a wood frame and cloth body provides a low profile platform wherein a patient may be rolled or slid upon the cloth body or patient surface. The wood and cloth stretcher is then lifted off of the ground by workers. While sliding or rolling a patient upon a low profile prior art cot stretcher presents a minimal risk of injury, manually lifting the stretcher presents a significant risk of injury.

In the related art, stretchers with mechanical means of lift are known, but present a raised profile, inviting injury to workers lifting a patient upon the raised platform. For example, U.S. Pat. No. 6,389,623 issued on May 21, 2002 to Flynn et al presents a modern iteration of the classical ambulance stretcher and discloses a flat stretcher near the ground and provides a scissor type frame to lift the stretcher off of the ground. FIG. 12 of Flynn presents a profile view of the stretcher in its lowest position and shows several components, vertically configured, between the patient surface and the ground. The existence of components between the patient surface and the ground represents a vertical distance requiring the manual lifting of a patient.

European patent application 90830259.9, publication No. EP 0 406 178 A2 by Corradi discloses a wheeled stretcher used to move a patient from a bed to a stretcher and vice versa. The Corradi stretcher relies upon a standing frame to keep the structure at a bed level and is not designed to lift a patient from the ground. While the Corradi stretcher will move a patient from bed to bed, Corradi fails to lift a patient from the ground.

The related art fails to disclose or suggest means or methods of providing a stretcher having a patient surface at near ground level and means of mechanically lifting the patient to a raised position. Health care workers currently injure themselves lifting up prior art wood and cloth stretchers or from lifting patients upon the raised platforms of prior art mechanical lifts. Thus, there are significant shortfalls in the art.

BRIEF SUMMARY OF THE INVENTION

The present invention overcomes shortfalls in the related art by presenting an unobvious and unique combination, configuration and use of components to present a low profile stretcher having mechanical means of lifting a patient in a horizontal position. Disclosed embodiments overcome shortfalls in the art by providing a unique set of components that are horizontally layered so as to present an initial low profile from the ground and efficient means of mechanical lift. The presently disclosed embodiments provide the low profile of a wood and cloth cot stretcher but with mechanical means of lifting a patient, thus greatly reducing the risk of injury to health care workers.

Disclosed embodiments overcome shortfalls in the art with an efficient configuration of an integrated piston design. Mechanical lift may be achieved by use of one or more integrated pistons that may be powered by any means such as hydraulics, hand or foot pumps, $CO_2$ cartridges, pulleys and hand cranks. The integrated piston system achieves a low profile and mechanical efficiency by attachment to an upper cross bar and attachment to a lower cross bar, with the lower cross bar moving within a track or void of a wheelie bar, with the lower cross bar further penetrating the wheelie bar and moving a wedge bar. The wedge bar may be retained to the inside of a top bar, with the top bar attached to a wedge. Starting in a flat position, as the piston is moved, the lower cross bar moves within a wheelie bar and moves the wedge bar into the wedge, causing an initial lifting movement.

The initial movement of the wedge bar into the wedge starts the initial movement of the wheelie bar. The longitudinal void of the wheelie bar not only retains the powered lower cross bar but also assists in transferring movement of the piston to angular movement of the wheelie bar.

These and other advantages over the prior art will become even more apparent after consideration of the drawings and more detailed description.

REFERENCE NUMERALS IN THE DRAWINGS

Figure 1:
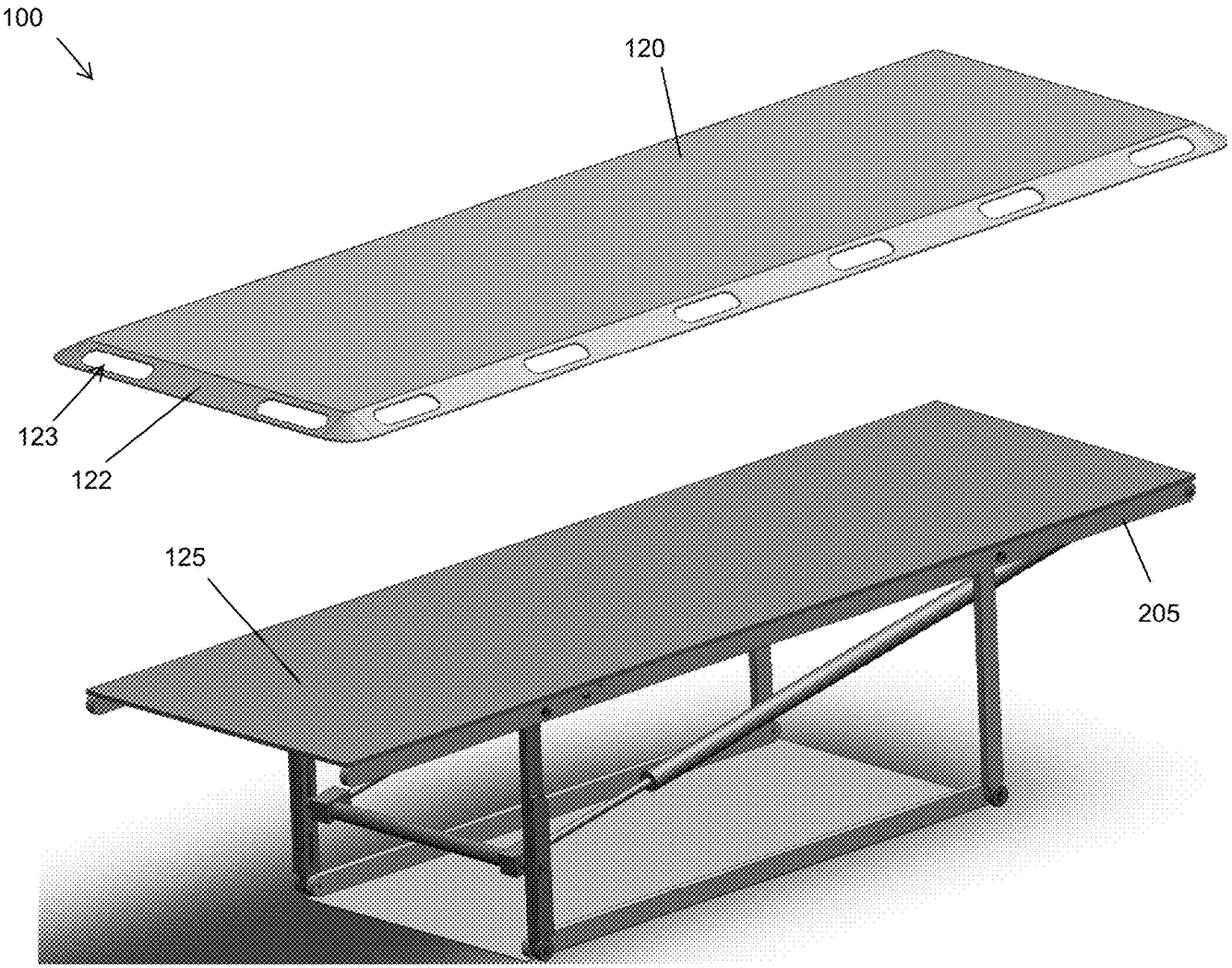
FIG. 1 is a perspective view of a lift system

100 lift in general
120 body board
122 angled wall or skirt of body board
123 hand void defined within the angled wall 122 of the body board 120
125 back board
205 top bar
210 cylinder rod cross head—upper cross bar, may be of same construction as cross bar or lower cross bar 275
240 wheelie bar
241 longitudinal void of wheelie bar 240, may retain cross bar 275
242 pivot attachment voids of wheelie bar 240
245 body or longitudinal body of wheelie bar 240
260 cylinder
265 piston
267 cylinder rod clevis
270 wedge bar
271 cambered edge of wedge bar 270 used with angled edge 281 of wedge 280
272 indent area of wedge bar, used to retain wedge washer
273 void of wedge bar
274 longitudinal body of wedge bar 270
275 cross bar or lower cross bar
276 distal insertion area, used to mate with void of wheelie bar
278 main longitudinal section of cross bar 275
279 retention area of cross bar 275, may be used to retain a cylinder rod clevis 267
280 wedge
281 angled edge of wedge 280, interfaces with cambered edge 271 of wedge bar 270
282 void or voids defined within a wedge
320 front strut
440 bottom bar
450 skid plate These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a perspective view of a disclosed embodiment 100 is shown in an expanded position. A disclosed embedment may include a body board 120 with the body board defining a plurality of hand voids within a tilted perimeter collar area. The body board may be easily removed from the system and may be sometimes considered to be free floating.

The body board 120 may be disposed upon a backboard 125 with the back board attached to two top bars 205.

Figure 2:
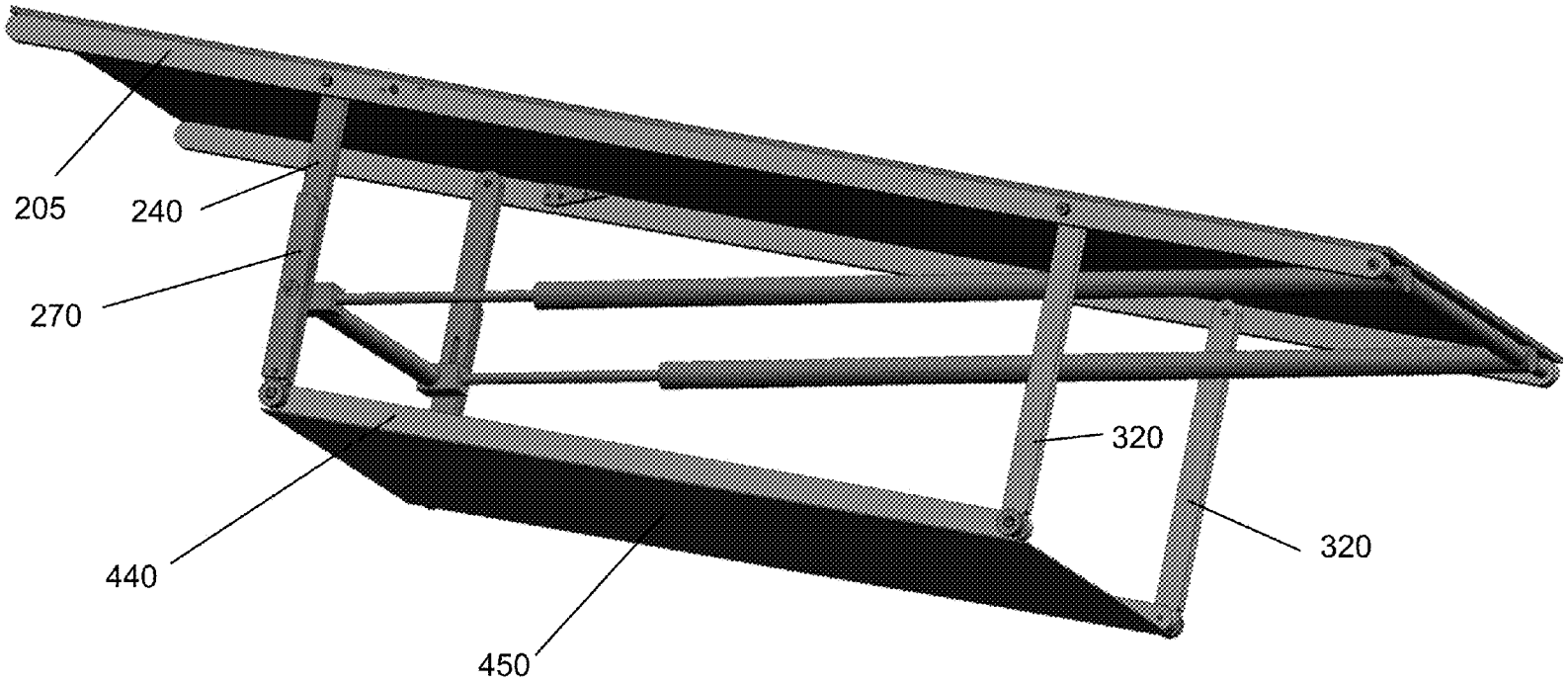
FIG. 2 is an exploded view of a lift system

Referring to FIG. 2, a perspective view of a system is shown in an expanded position with two top bars 205 held in parallel with two bottom bars 440. A pair of front struts 320 and a pair of wheelie bars 240 may be hingedly attached to the bottom bars and top bars. In the expanded position shown, a patient has been raised from a very low position with mechanical means, thus preserving the backs of the involved health workers. Disclosed embodiments may also include a skid plate 450, attached to the pair of bottom bars 440. The skid plate assists in sliding the system over grass or other difficult terrain. The use of a skid plate is optional and wheels may be attached to the bottom components to comport with environmental conditions.

Figure 3:
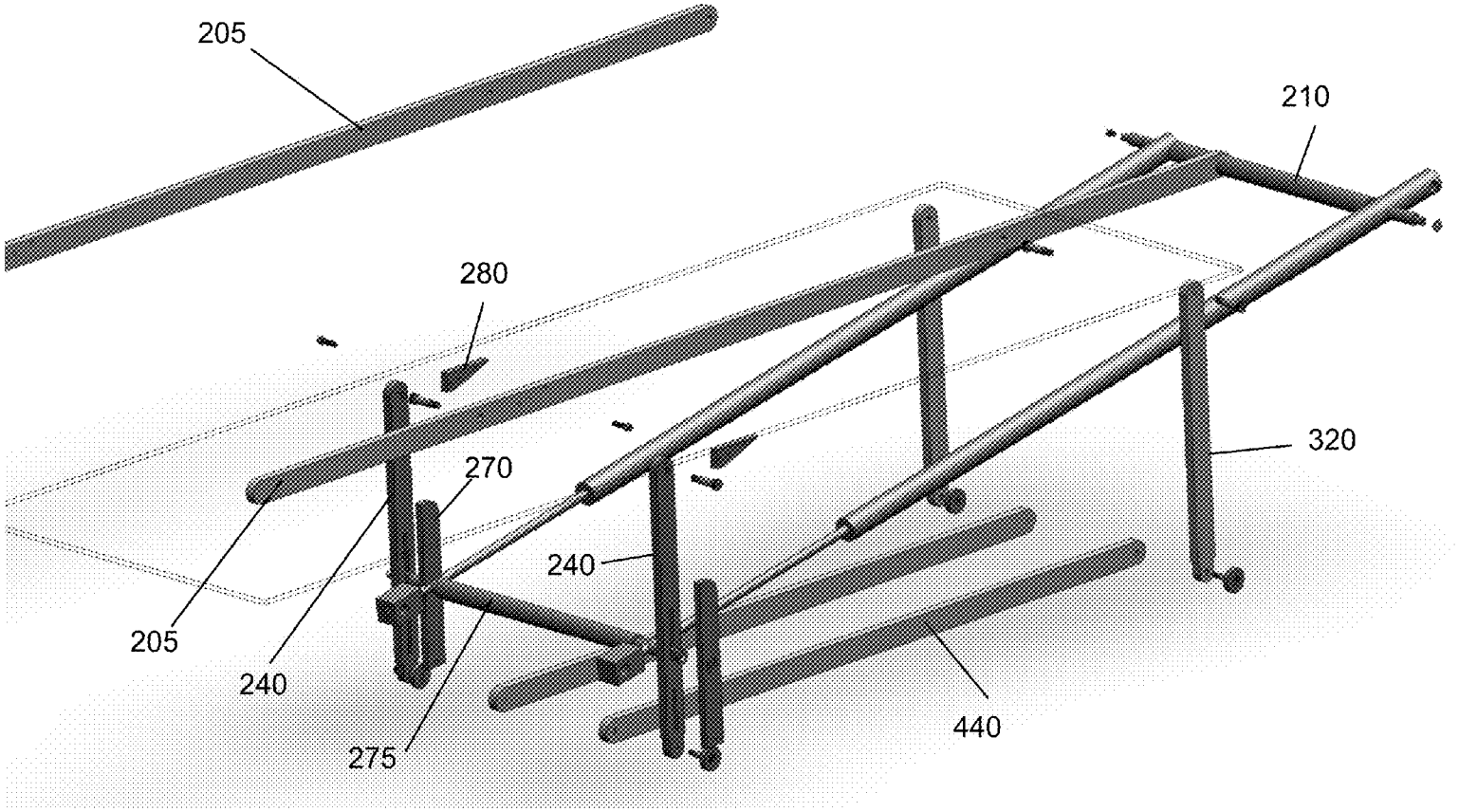
FIG. 3 is an exploded view of a lift system

FIG. 3 depicts an exploded view of a system in an expanded position.

Figure 31:
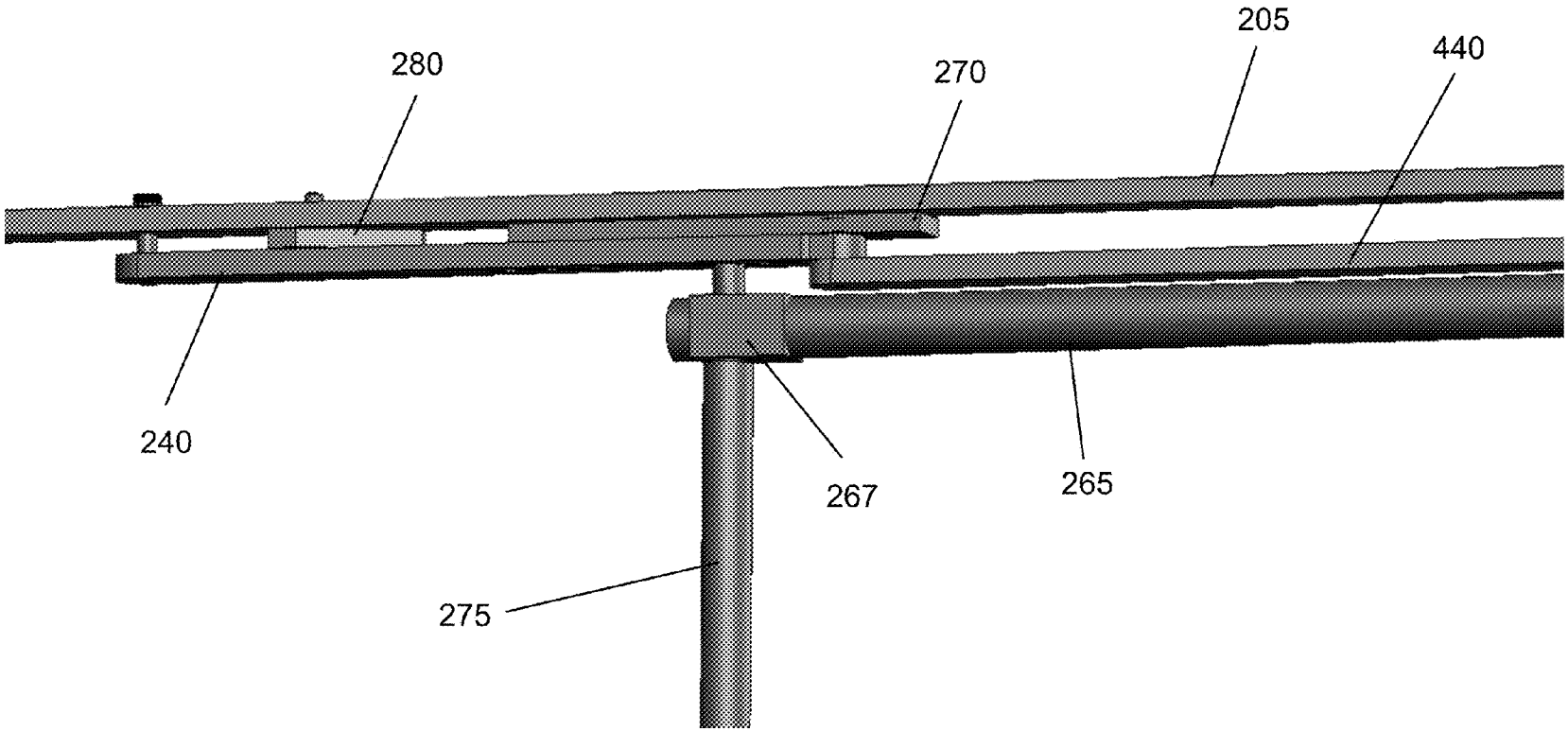
FIG. 31 is a perspective view of disclosed components in a flat position

To assist in the movement of the system from a flat positon to an expanded position, each of the two wheelie bars 240 is slidably attached to a wheelie bar 240. Starting in a flat position, as shown in FIG. 31, a piston rod 265 is attached to a cylinder rod clevis 267, with the clevis attached to a cross bar 275, the cross bar having distal ends extending through a wheelie bar 240 and the cross bar distal ends attached to a wedge bar 270. As the piston rod is outwardly urged, by use of pressure added to a cylinder 260, the wedge bar 270 is moved into a wedge 280, with the wedge having an angled edge 281 (shown in FIG. 35) urging the wedge bar to move upwardly which in turn causes the attached wheelie bar 240 to move into a vertical position. As the pair of wheelie bars 240 move into a vertical position, the attached top bars move upwardly causing the two front struts to rotate into a vertical position.

Figure 4:
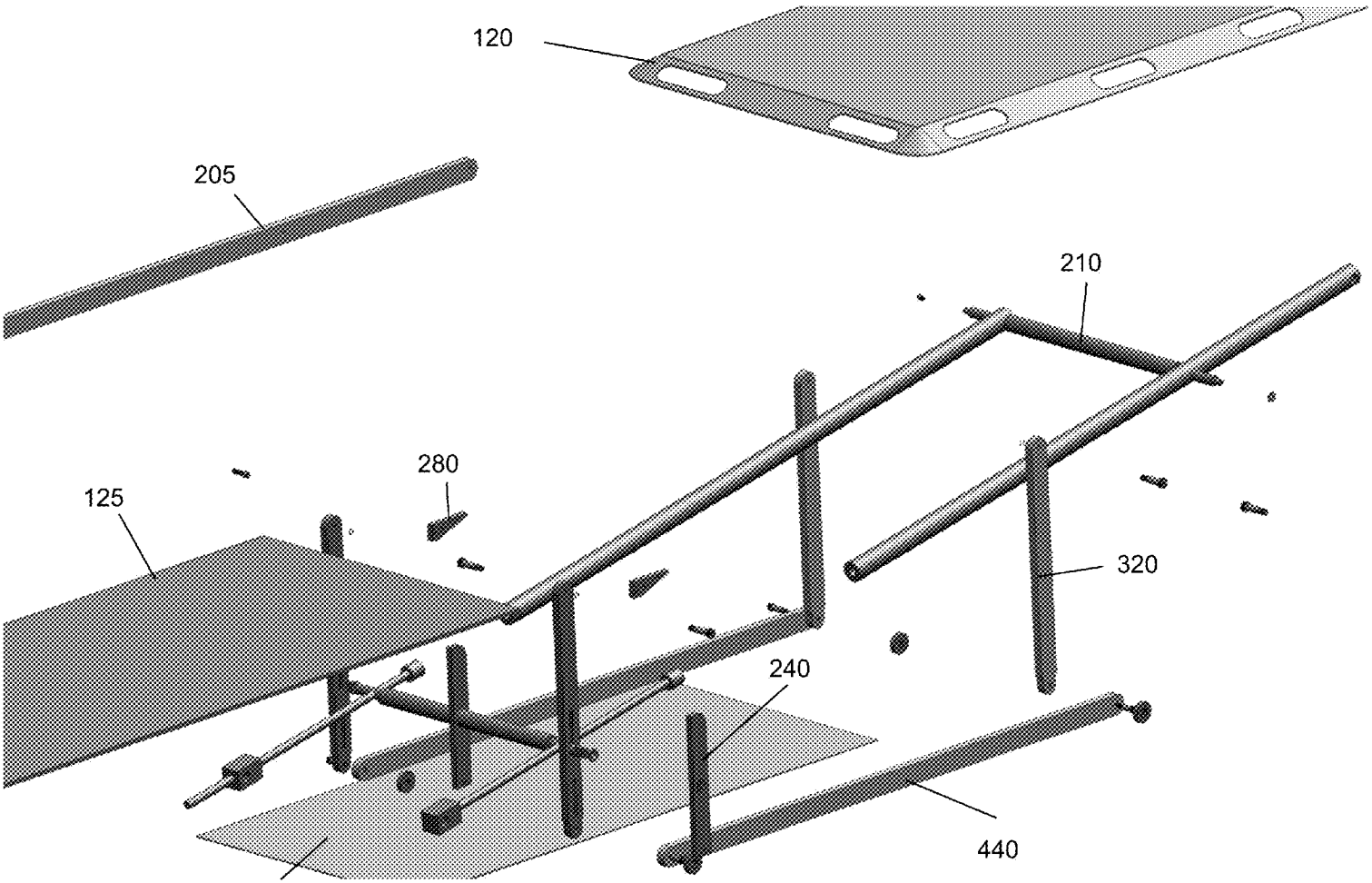
FIG. 4 is a perspective view of disclosed components

FIG. 4 depicts an exploded view of a system in an expanded position.

Figure 5:
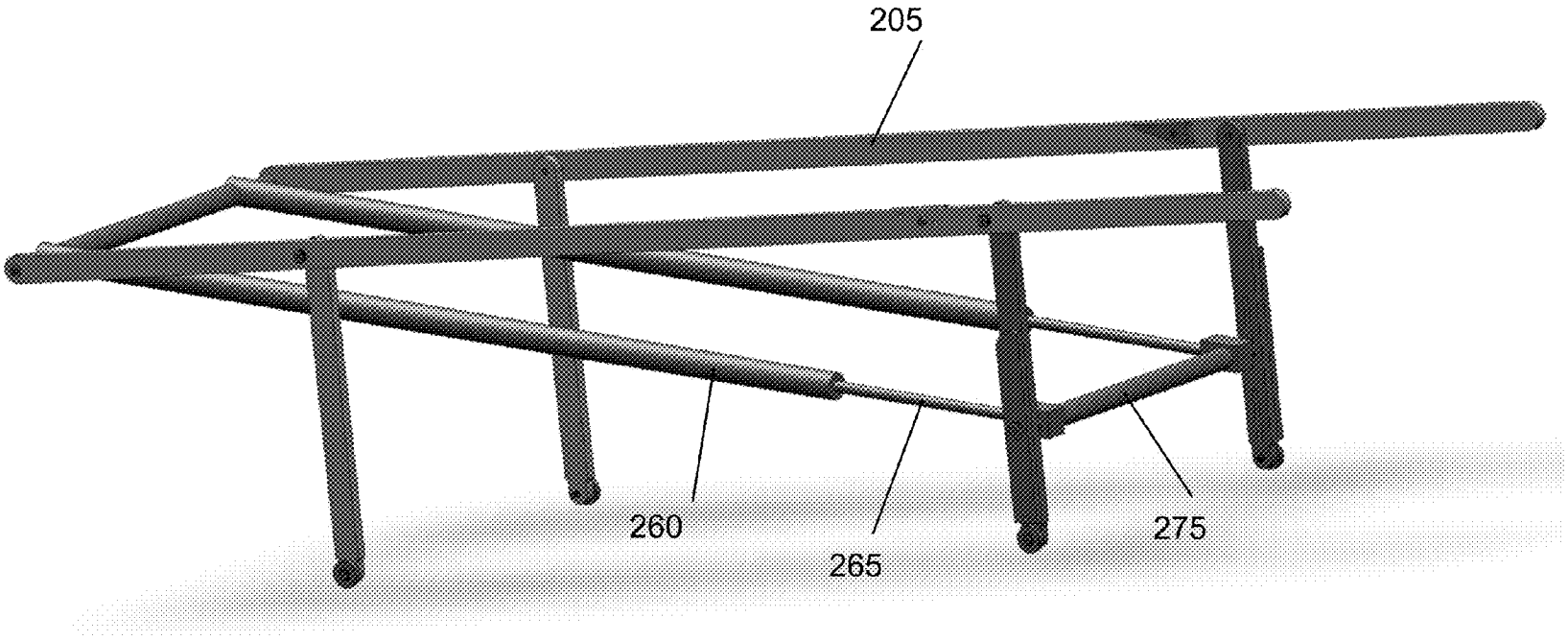
FIG. 5 is a perspective view of disclosed components

FIG. 5 depicts a perspective view of a system with the skid plate and back board removed.

Figure 6:
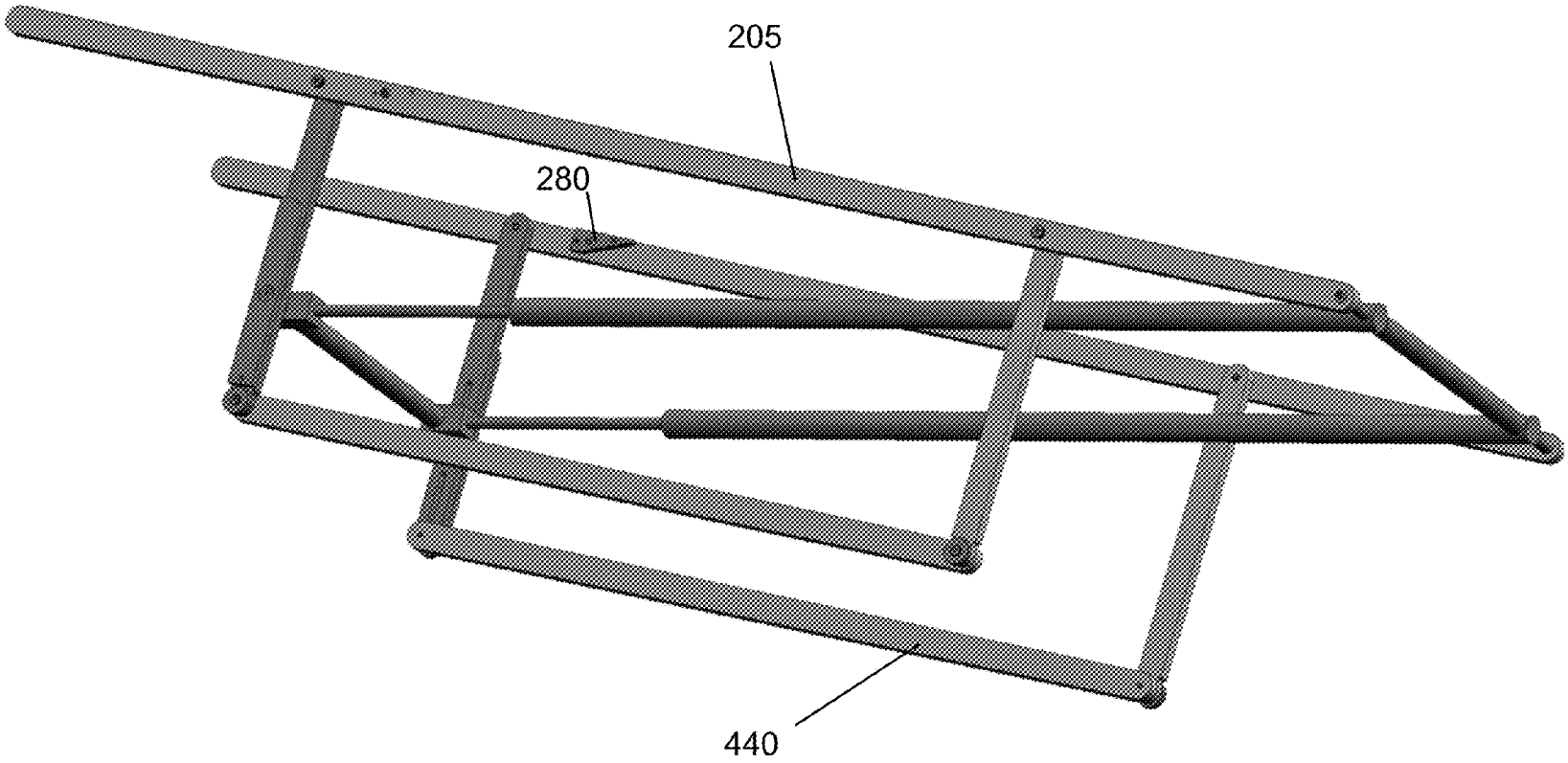
FIG. 6 is a perspective view of disclosed components

FIG. 6 depicts a perspective view of a system in an expanded position. A wedge 280 is depicted in attachment to a top bar 205.

Figure 7:
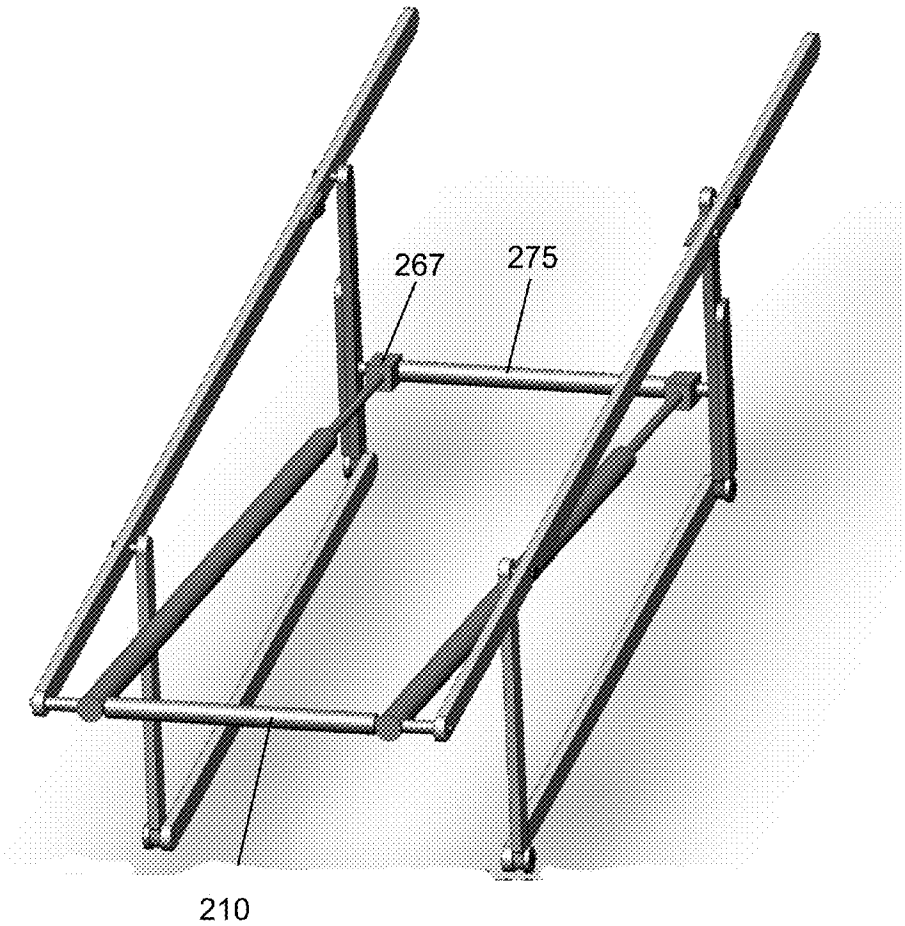
FIG. 7 is a perspective view of disclosed components

FIG. 7 depicts a perspective view of a system in an expanded position. A cylinder rod cross head 210 or upper cross bar is shown in the foreground while a lower cross bar 275 is shown in the background.

Figure 8:
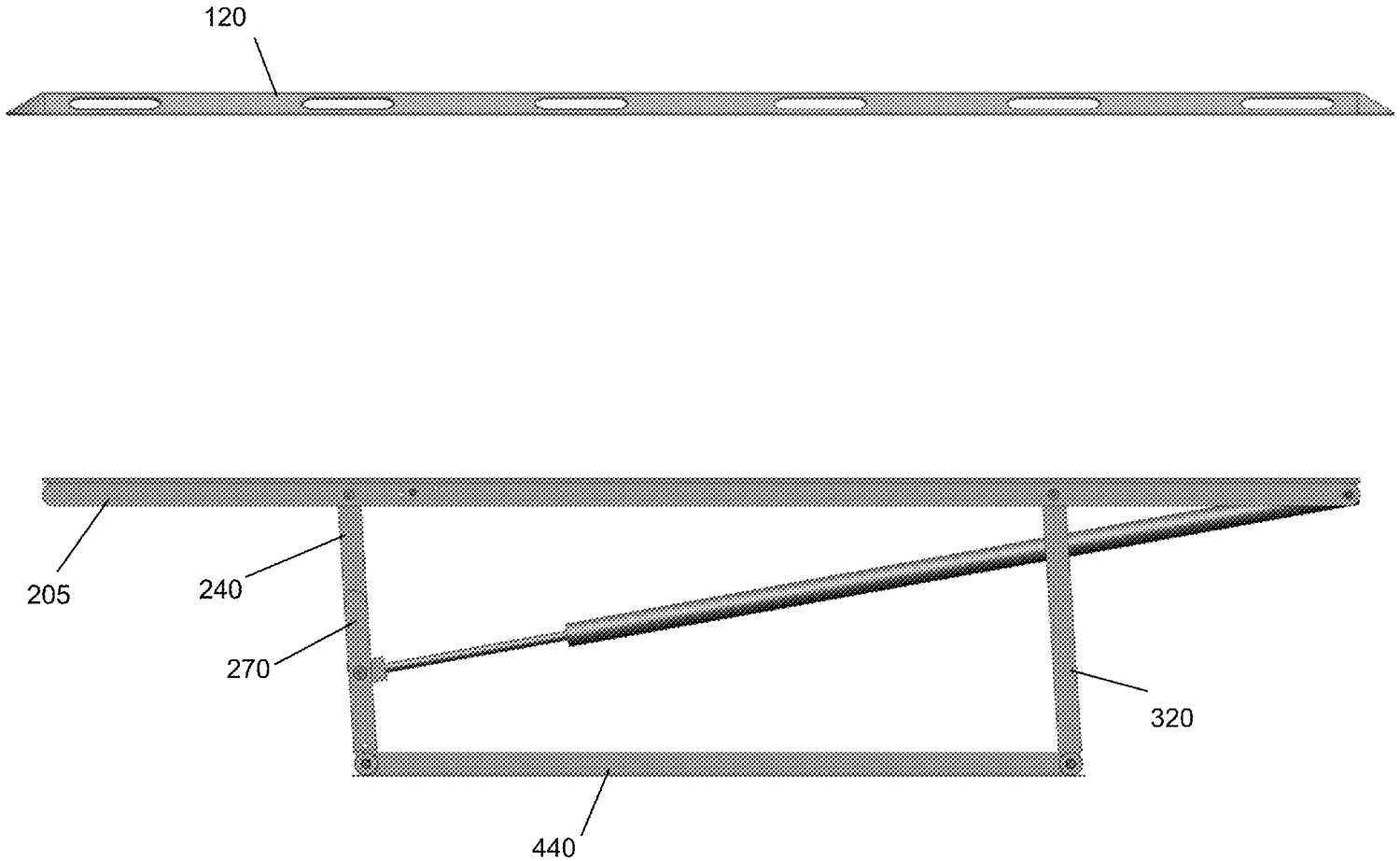
FIG. 8 is a sectional view of disclosed components

FIG. 8 depicts a sectional view of a system in an expanded position. An optional body board 120 is shown to be removable without tools. A top bar 205 is shown at a ninety degree angle or normal to a wheelie bar and wedge bar 270, the wedge bar attached to the wheelie bar.

Figure 9:
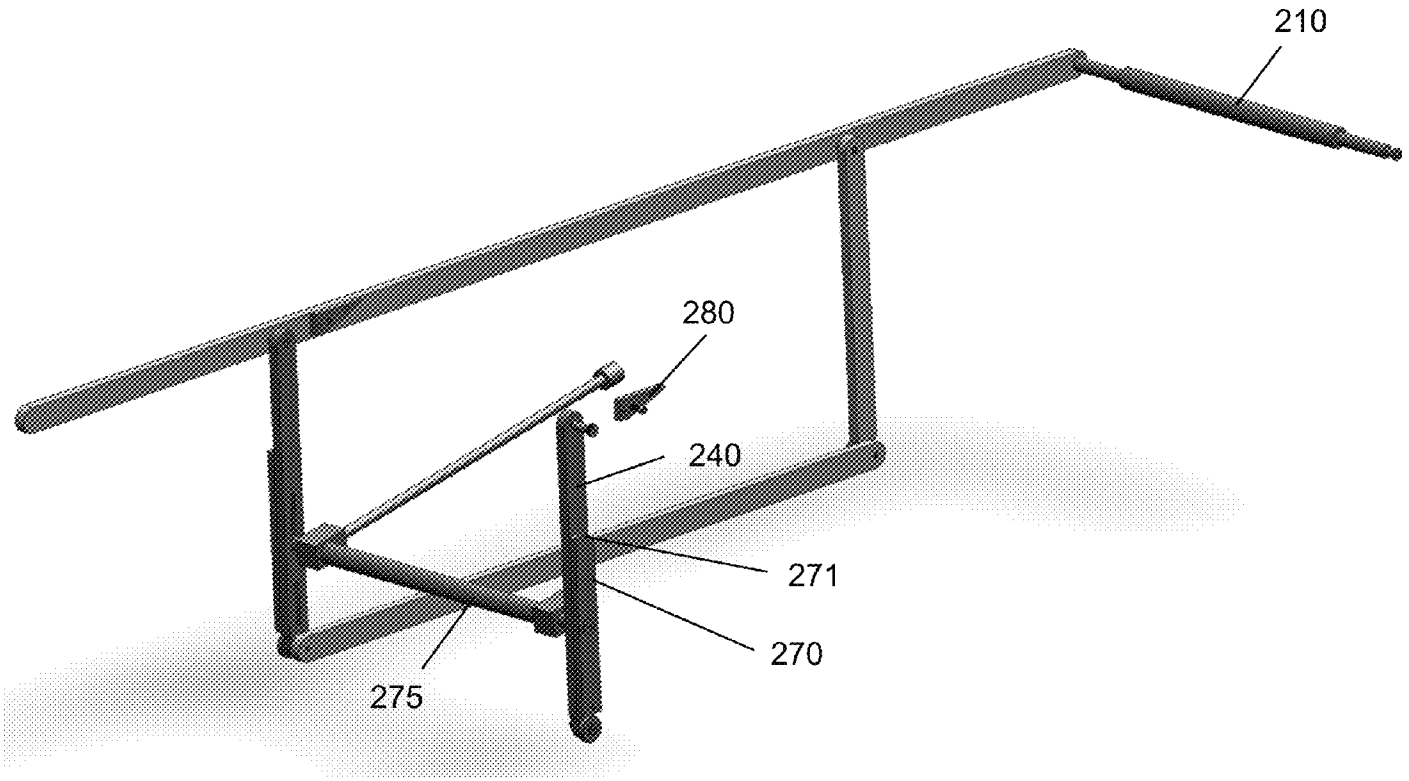
FIG. 9 is a perspective view of disclosed components

FIG. 9 depicts a perspective view of a system in an expanded position. A cross bar 275 or lower cross bar is attached to a wheelie bar 240. A wedge 280 is shown to help illustrate the interrelationship between the wedge and the cambered edge 271 of the wheelie bar.

Figure 10:
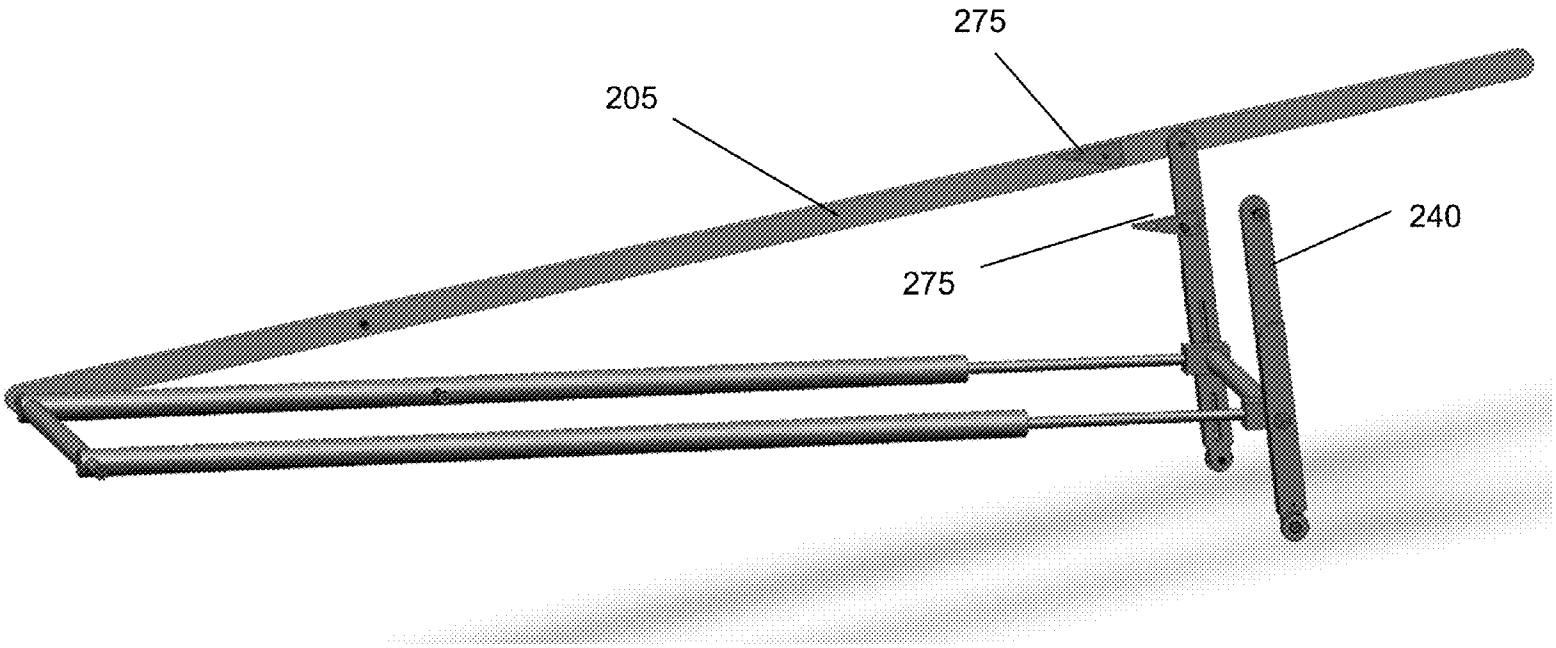
FIG. 10 is a perspective view of disclosed components

FIG. 10 depicts a perspective view of a system in an expanded position. One wedge bar 275 is shown in attachment to a top bar 205 and a second wedge bar 275 is shown as unattached.

Figure 11:
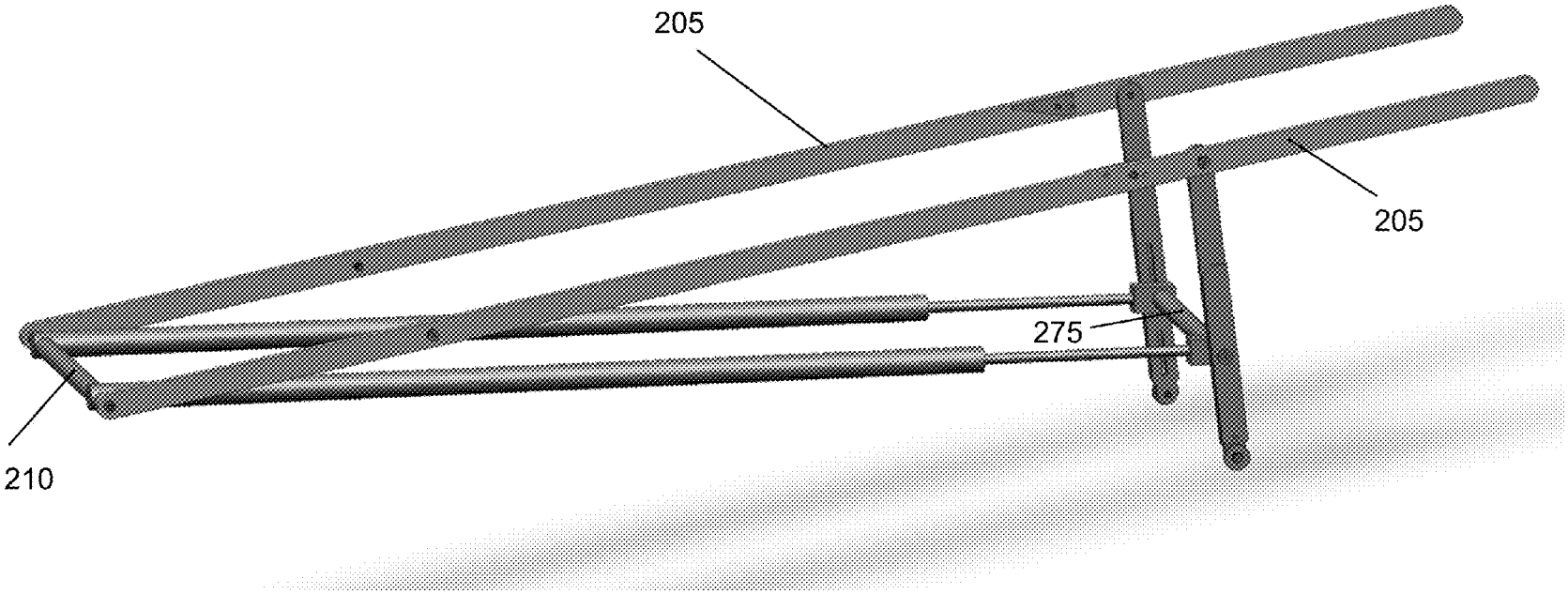
FIG. 11 is a perspective view of disclosed components

FIG. 11 depicts a perspective view of FIG. 10 but with a second top bar 205 added.

Figure 12:
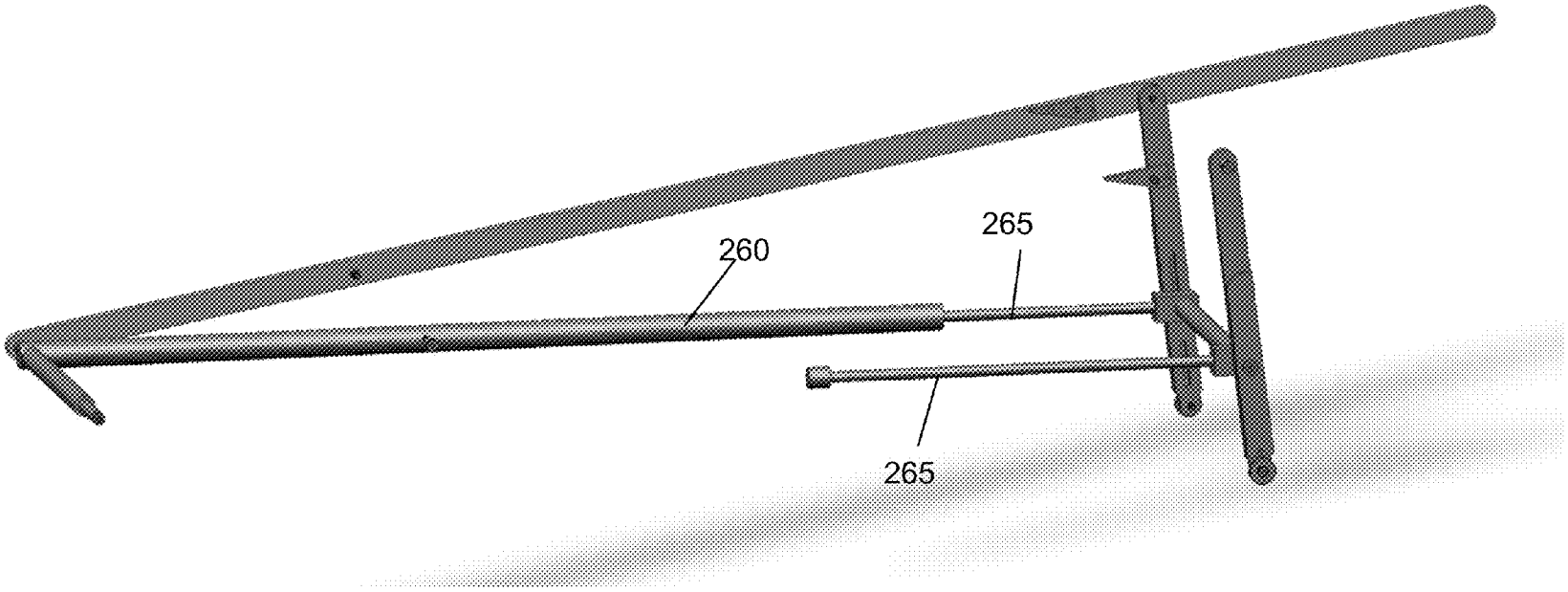
FIG. 12 is a perspective view of disclosed components

FIG. 12 depicts a perspective view of a system in an expanded state. A piston 265 is shown in the foreground and a piston 265 attached to a cylinder is shown in the back ground.

Figure 13:
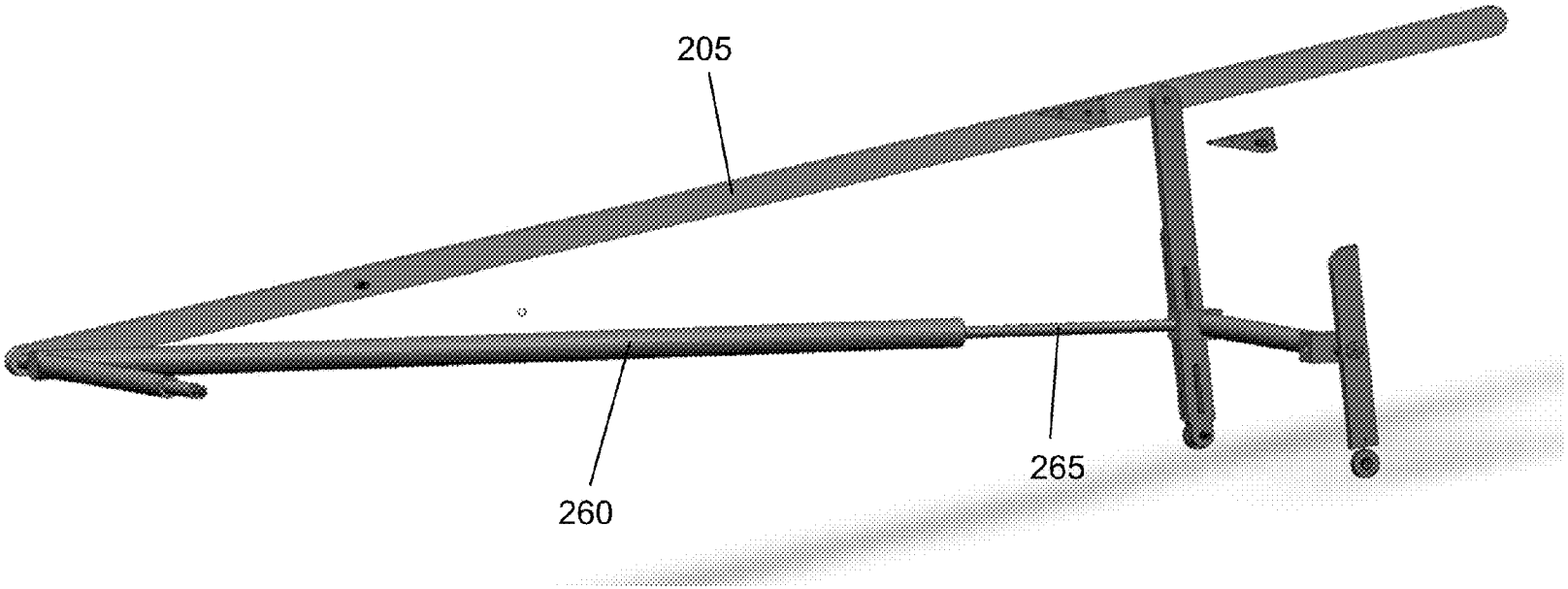
FIG. 13 is a perspective view of disclosed components

FIG. 13 depicts a perspective view of system components in an expanded position. A piston 265 is shown in attachment to a cylinder 260.

Figure 14:
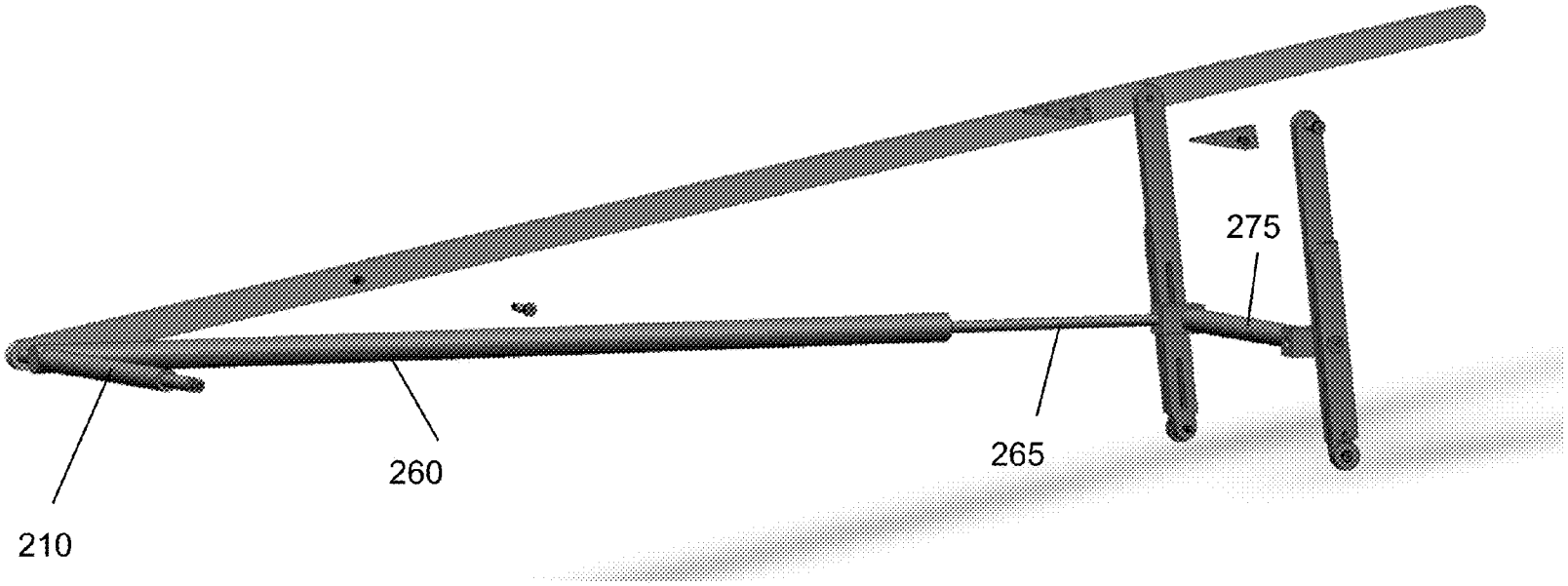
FIG. 14 is a perspective view of disclosed components

FIG. 14 depicts a cylinder rod cross head 210 or upper cross bar attached to a cylinder 260 with the cylinder attached to a piston 265 and the piston attached to a lower cross bar 275.

Figure 15:
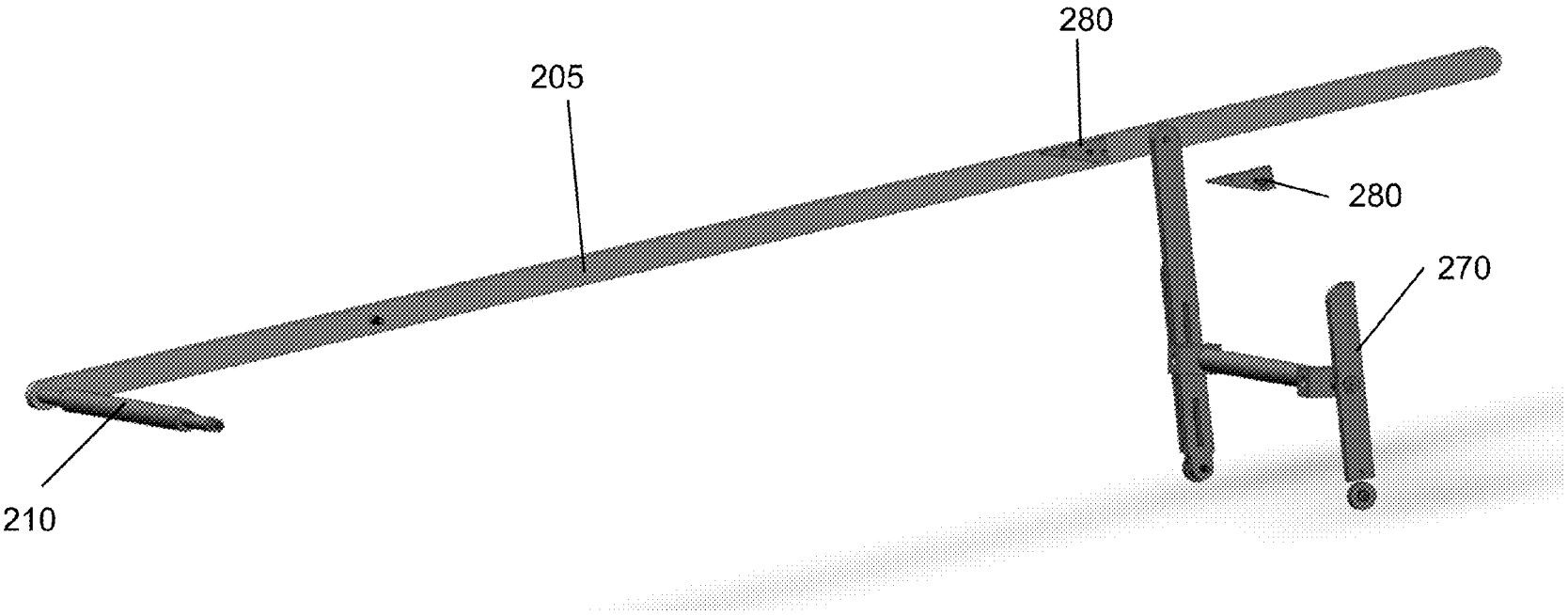
FIG. 15 is a perspective view of disclosed components

FIG. 15 depicts a view of FIG. 14 with the cylinder and the piston removed.

Figure 16:
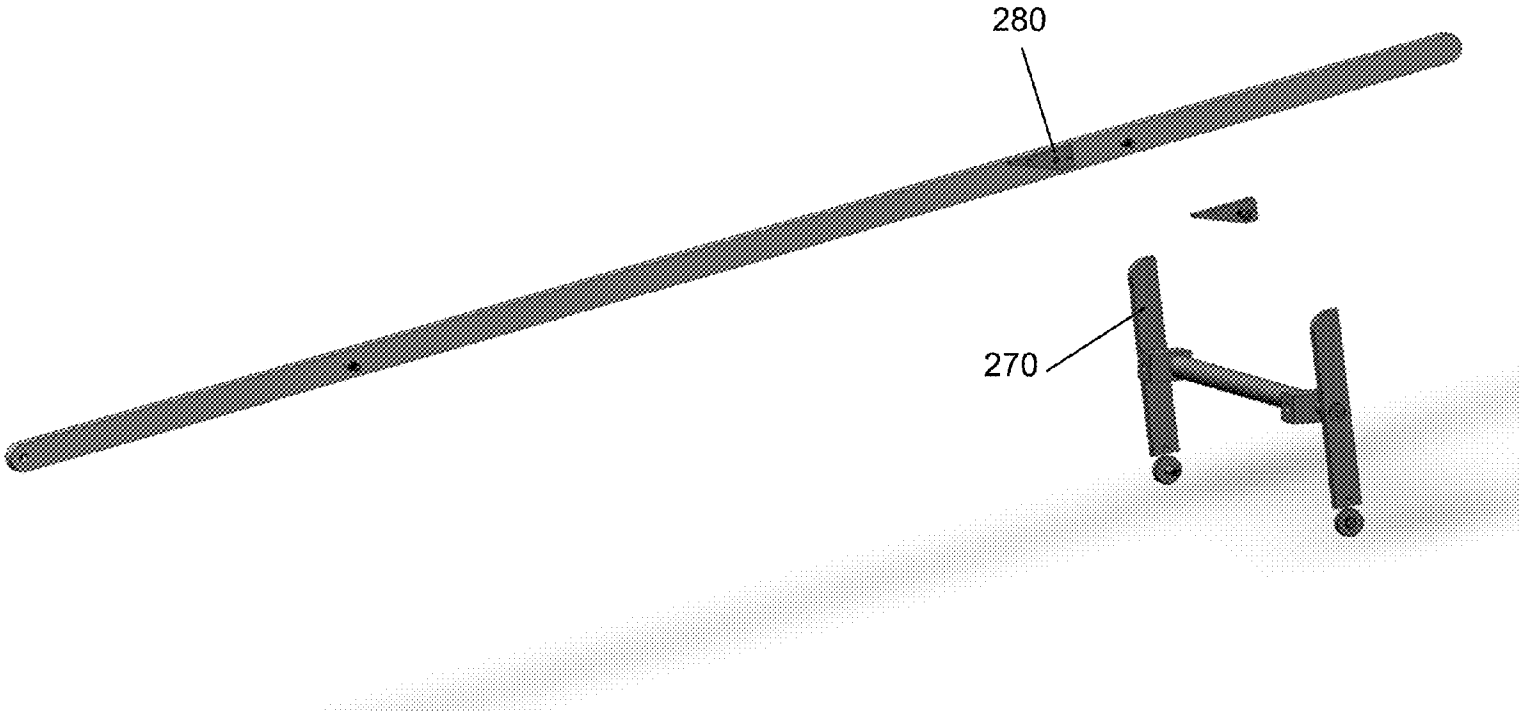
FIG. 16 is a perspective view of disclosed components

FIG. 16 depicts a view of FIG. 15 with the upper cross bar removed.

Figure 17:
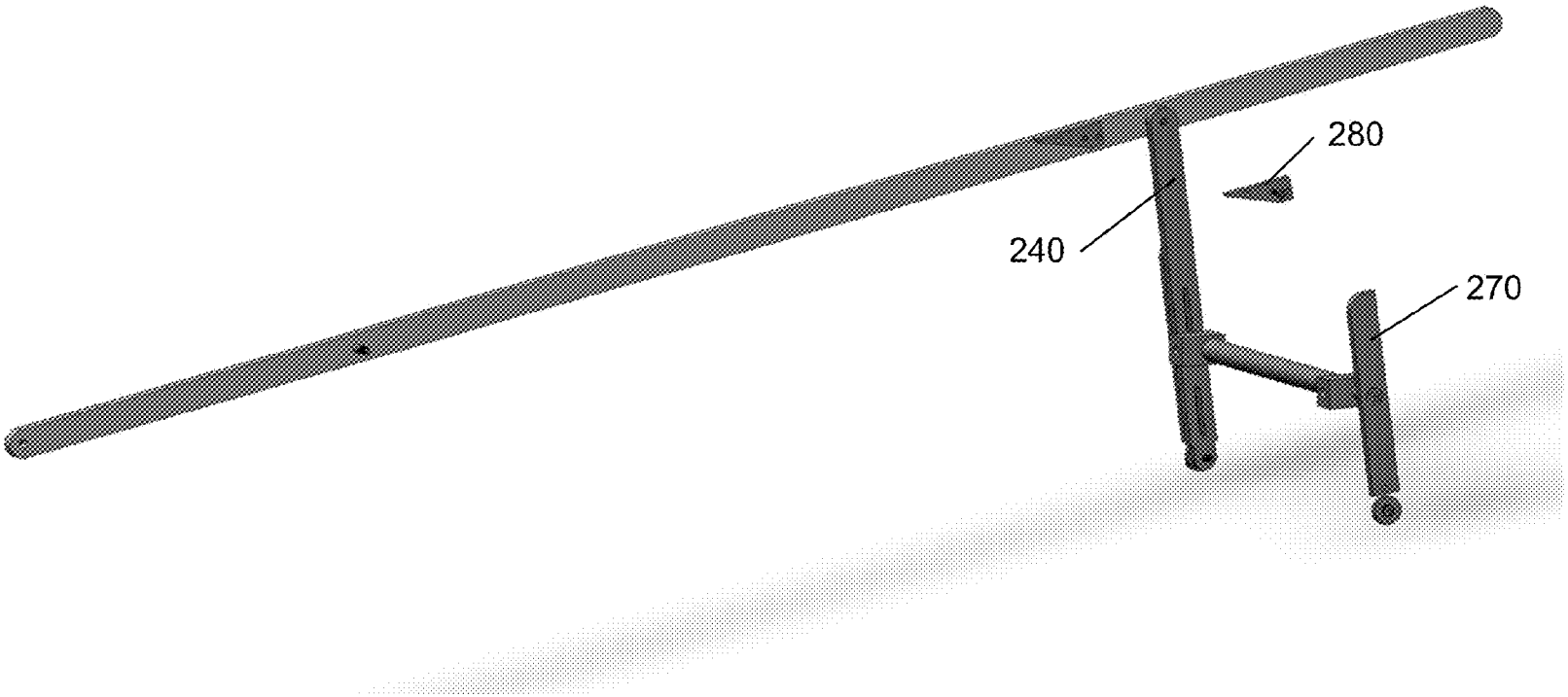
FIG. 17 is a perspective view of disclosed components

FIG. 17 depicts a view of FIG. 16 but adds a wheelie bar 240.

Figure 18:
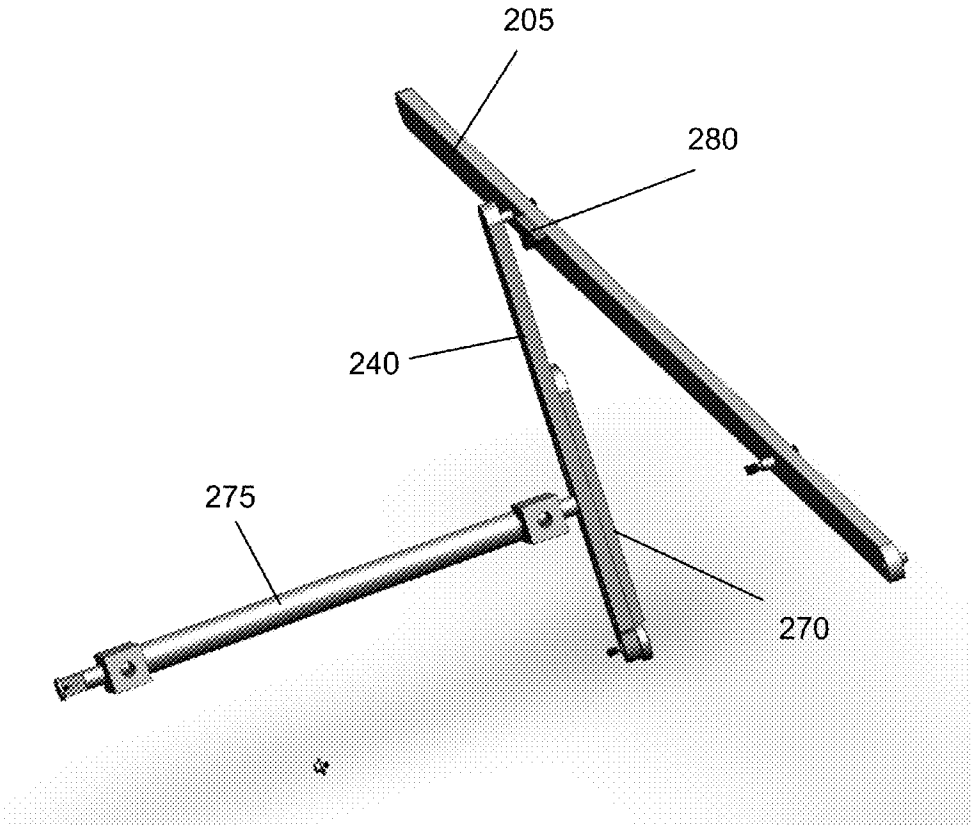
FIG. 18 is a perspective view of disclosed components

FIG. 18 depicts a perspective view of a lower cross bar 275 passing through a void in the wheelie bar and attaching to a wedge bar 270. The wheelie bar 240 is shown to be in pivotal attachment to a top bar 205 with the top bar attached to wedge 280.

Figure 19:
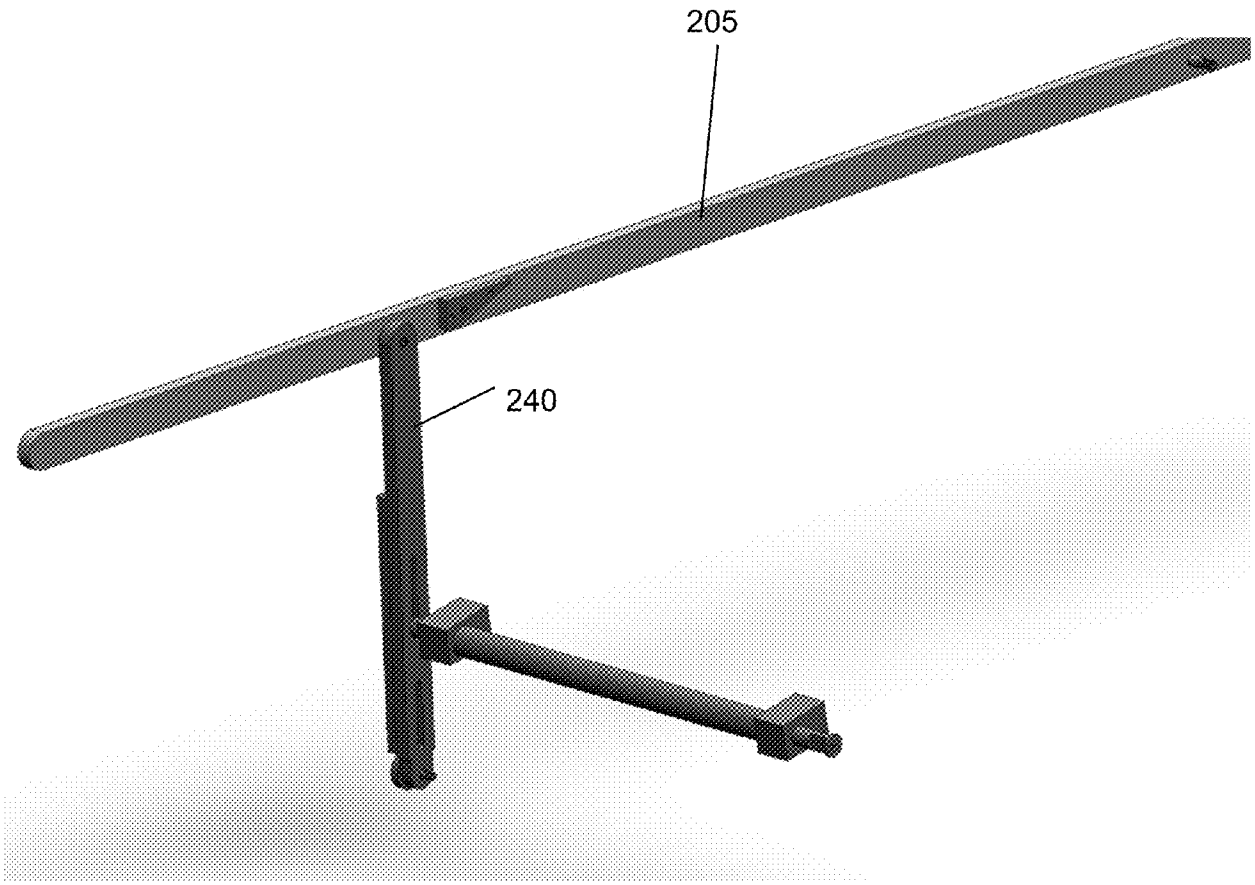
FIG. 19 is a perspective view of disclosed components

FIG. 19 depicts disclosed components in an expanded position.

Figure 20:
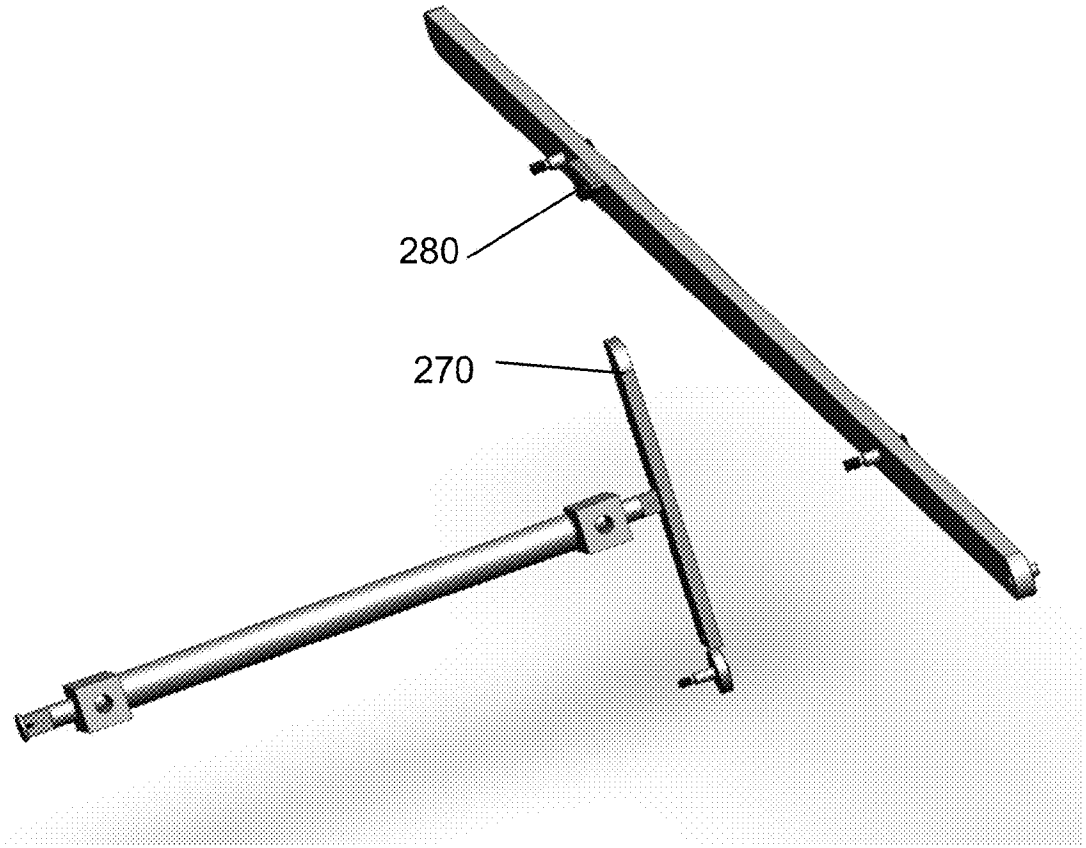
FIG. 20 is a perspective view of disclosed components

FIG. 20 depicts a view of FIG. 18 with the wheelie bar removed.

Figure 21:
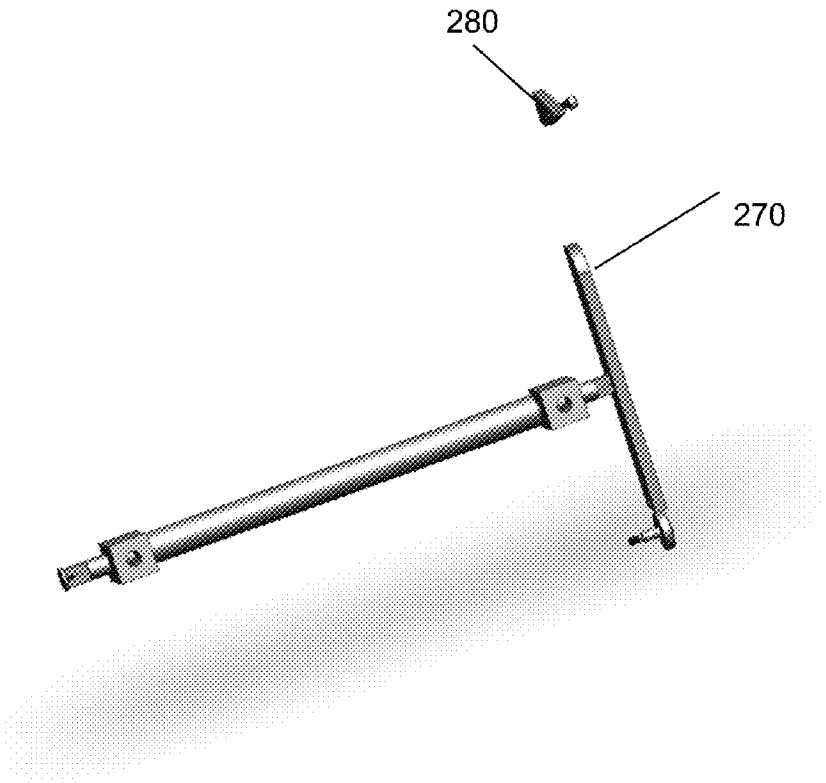
FIG. 21 is a perspective view of disclosed components

FIG. 21 depicts a view of FIG. 20 with the top bar removed.

Figure 22:
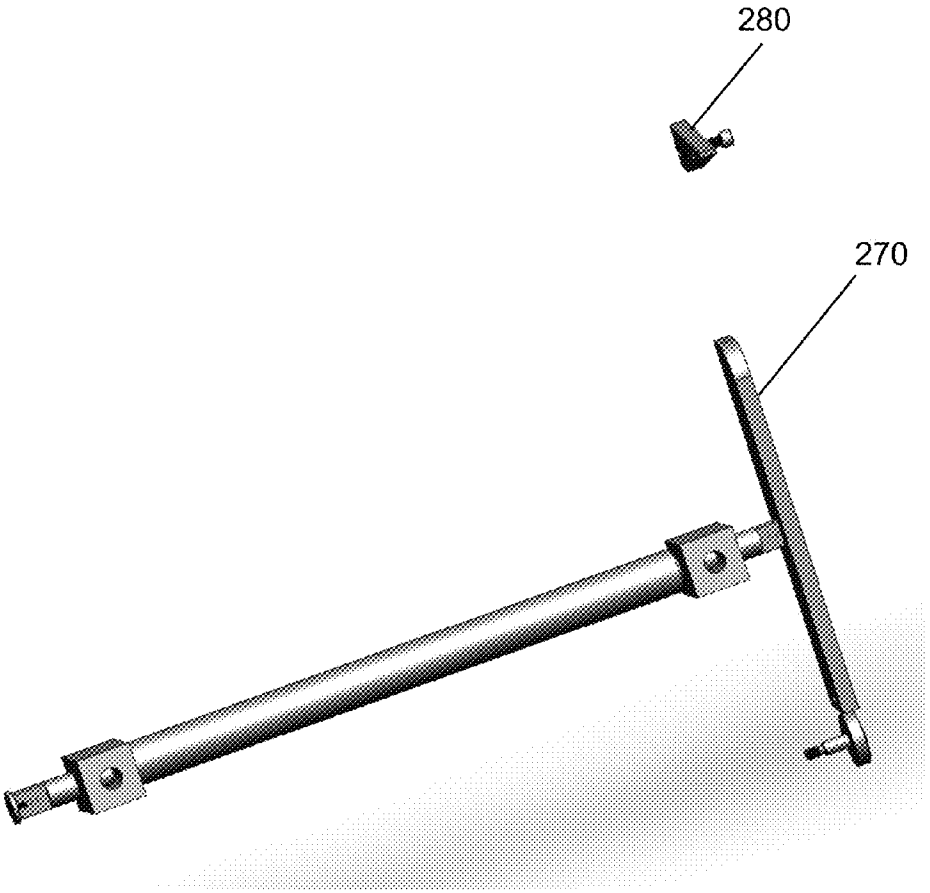
FIG. 22 is a perspective view of disclosed components

FIG. 22 depicts an alternative perspective to the view shown in FIG. 21.

Figure 23:
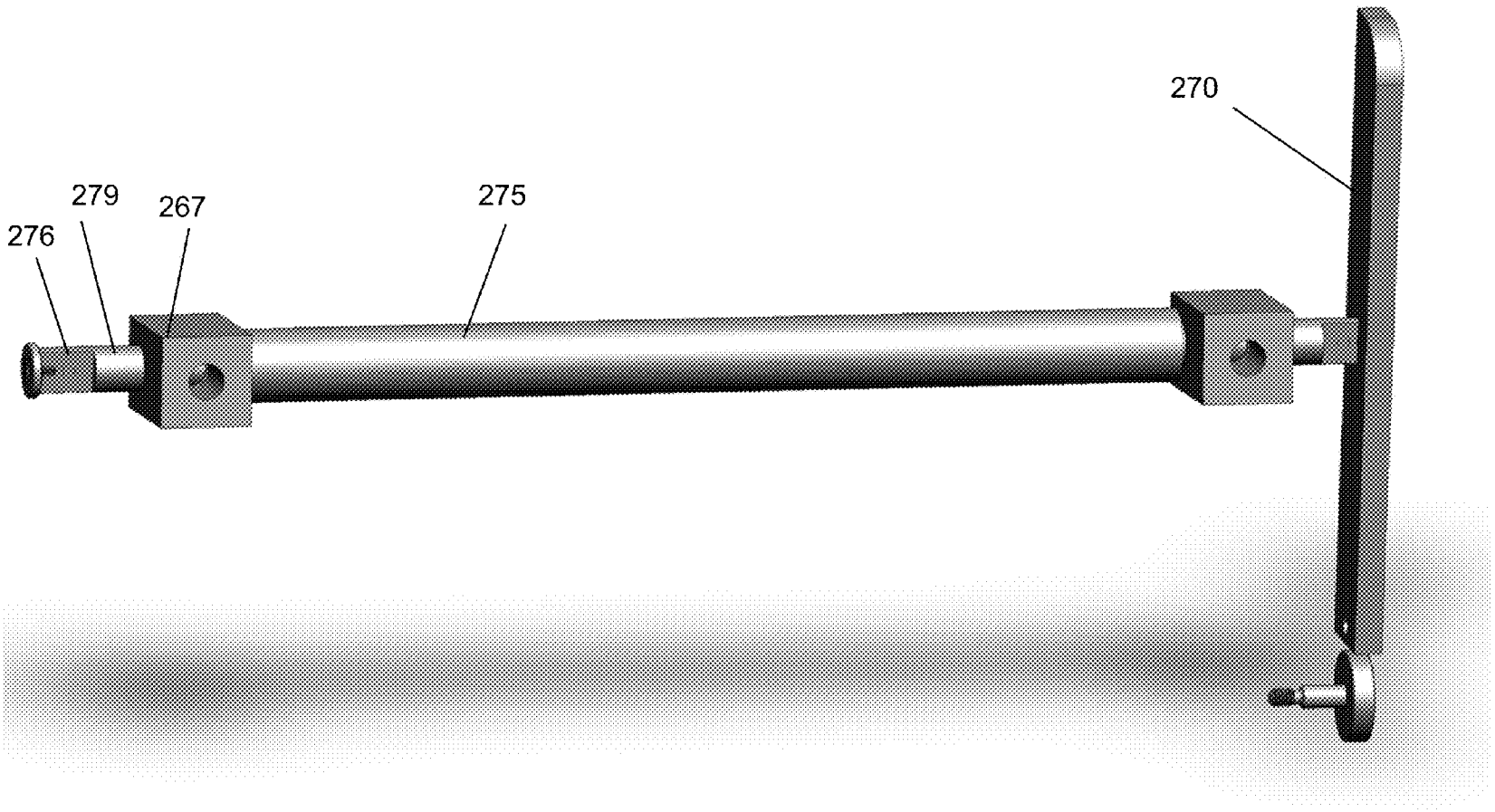
FIG. 23 is a perspective view of disclosed components

FIG. 23 depicts a perspective view of lower cross bar components with the lower cross bar attached to a wedge bar 270. A lower cross bar 275 may comprise or be attached to a cylinder rod clevis 267, a retention area 279 used to retain a cylinder rod clevis and a distal insertion area 276 with the distal insertion area used to mate with or intersect with a wheelie bar and/or a wedge bar.

Figure 24:
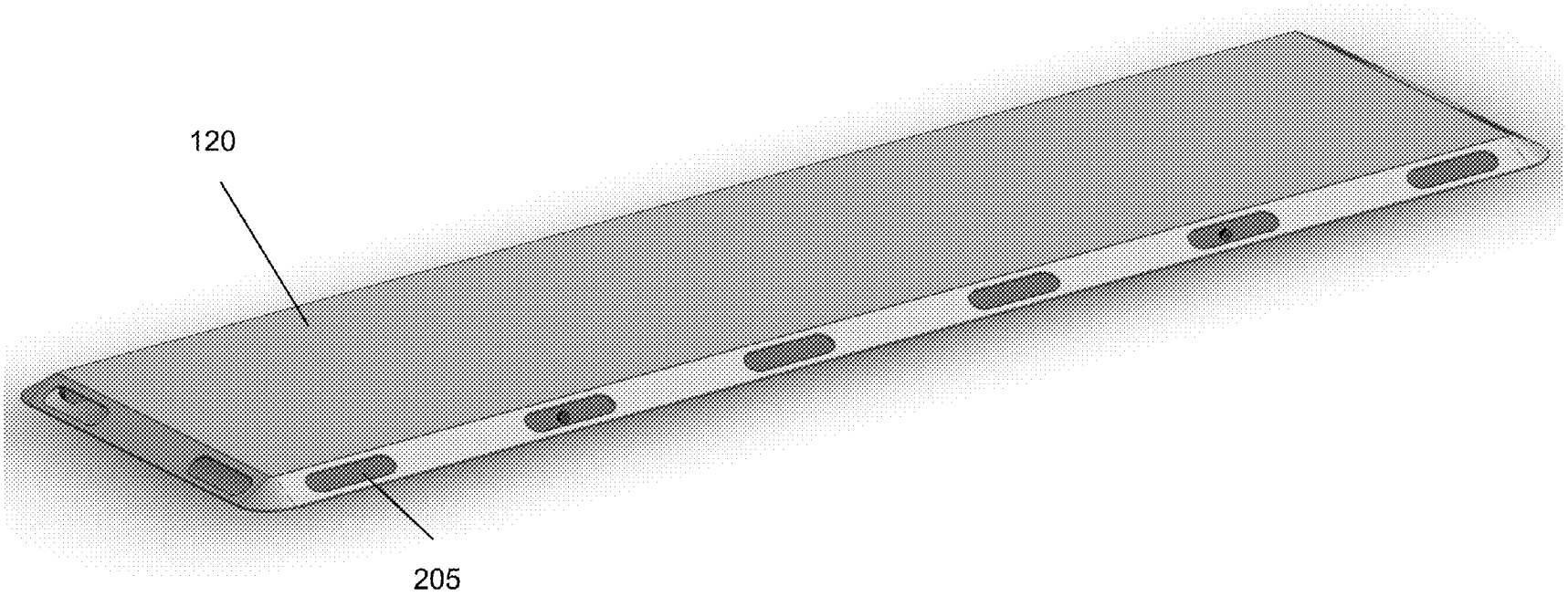
FIG. 24 is a perspective view of disclosed components

FIG. 24 depicts body board 120 comprising an angled wall or skirt section with the angled wall defining a plurality of hand voids. A top bar 205 may be seen through a hand void.

Figure 25:
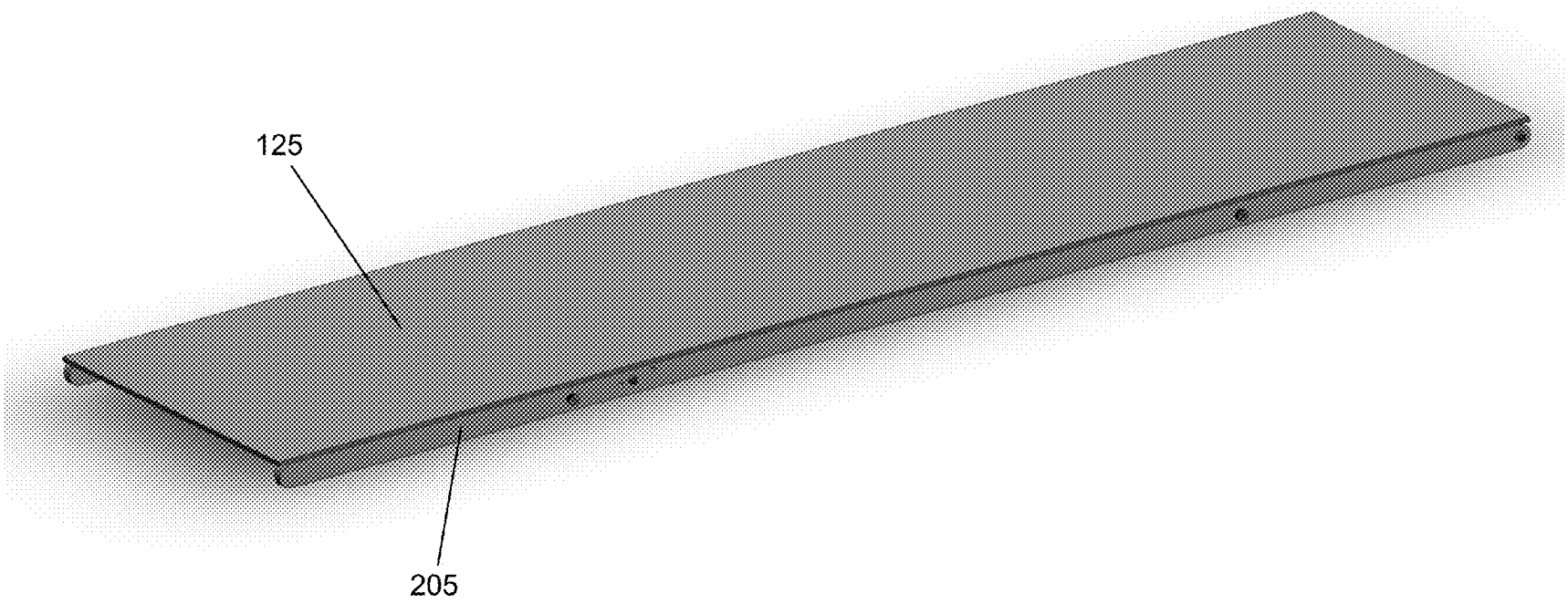
FIG. 25 is a perspective view of disclosed components

FIG. 25 depicts the view of FIG. 24 with the body board removed. A system is shown in a folded position, ready to accept a load, such as a patient or person in need of assistance. A top bar 205 may be seen in the foreground. A back board 125 is shown to be above the top bar.

Figure 26:
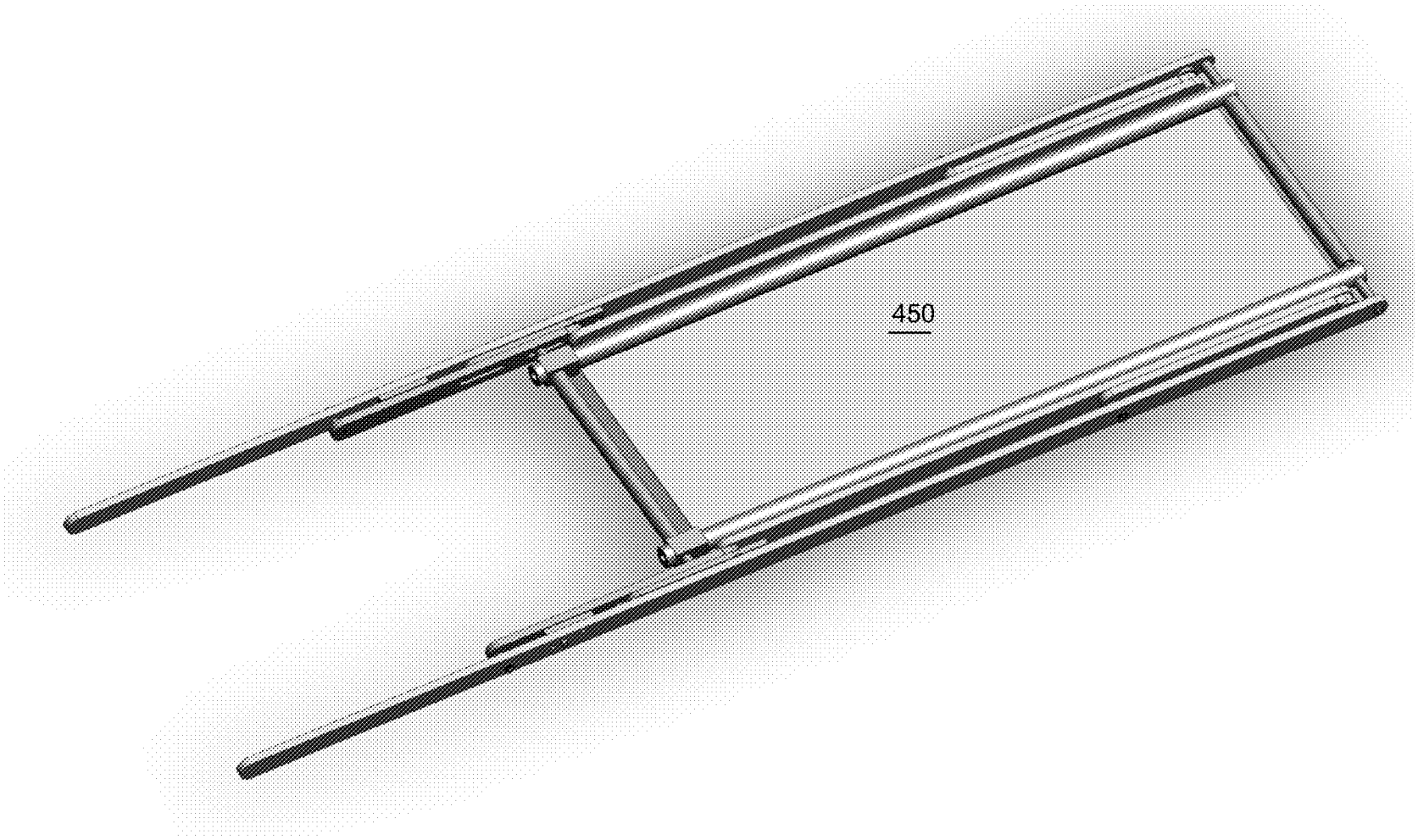
FIG. 26 is a perspective view of disclosed components

FIG. 26 depicts a perspective view of a system in a folded position with an optional skid plate 450.

Figure 27:
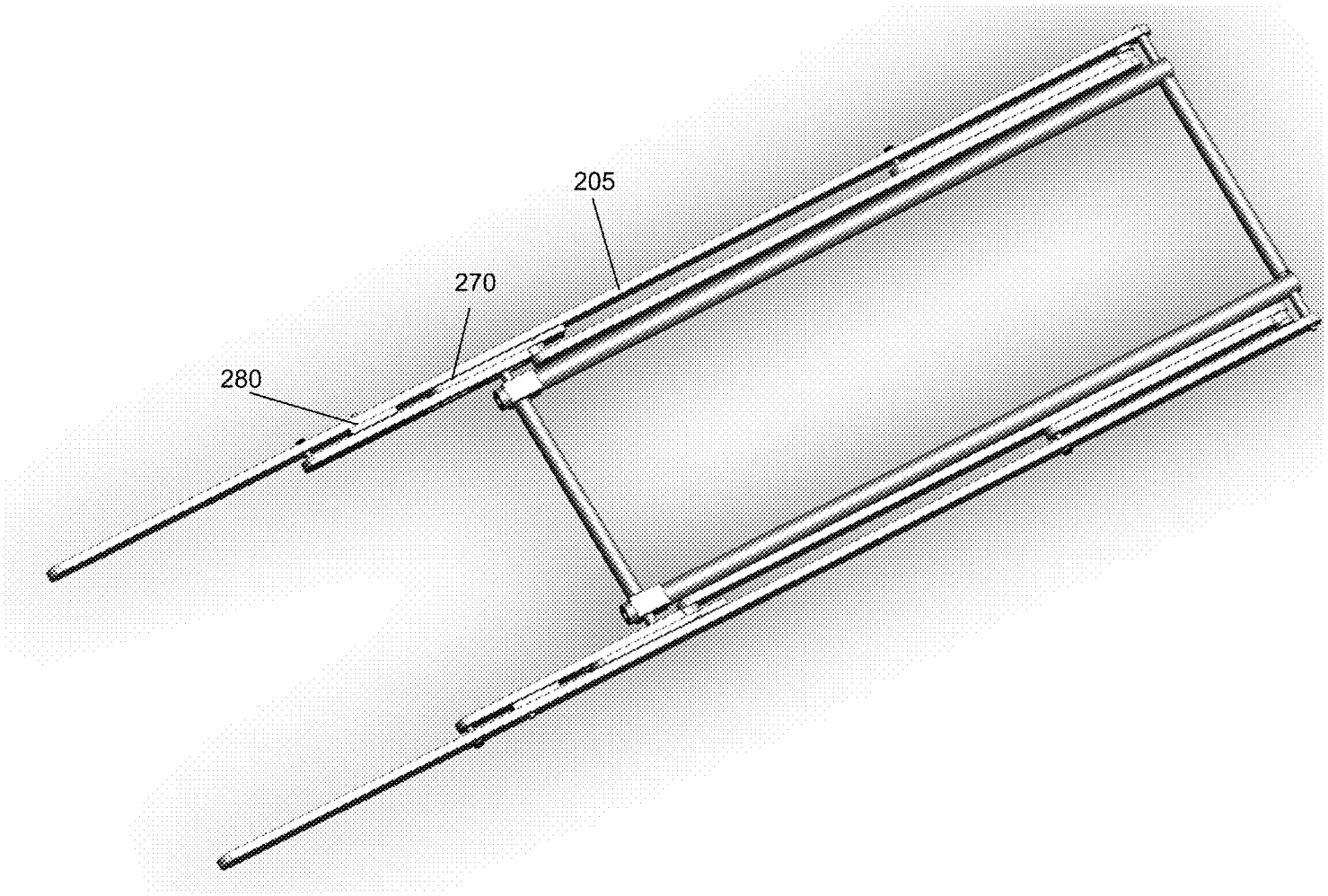
FIG. 27 is a perspective view of disclosed components

FIG. 27 depicts a view of FIG. 26 with the skid plate removed. The linear relationship between the wedge 280 and the wedge bar 270 can be seen with the system in the folded position. Both the wedge and wedge bar are initially along the same plane was the top bar 205.

Figure 28:
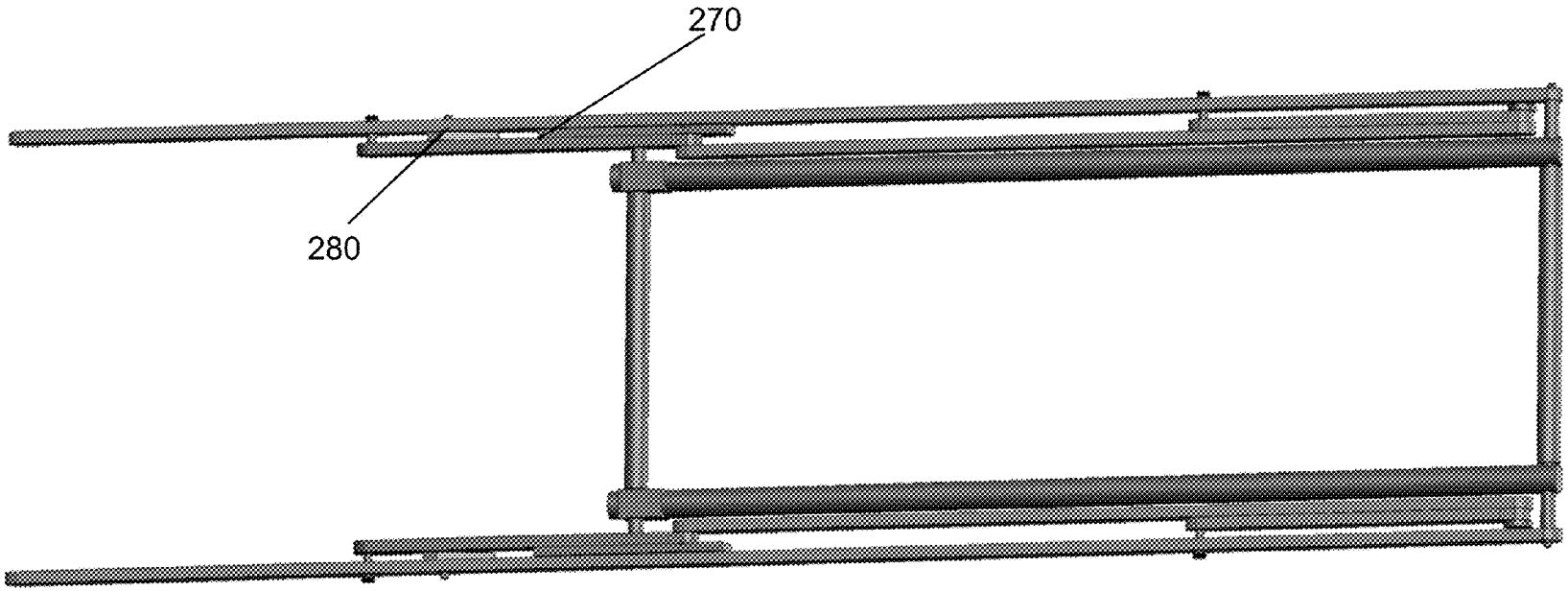
FIG. 28 is a perspective view of disclosed components

FIG. 28 depicts another view of the relationship between the wedge 280 and wedge bar 270.

Figure 29:
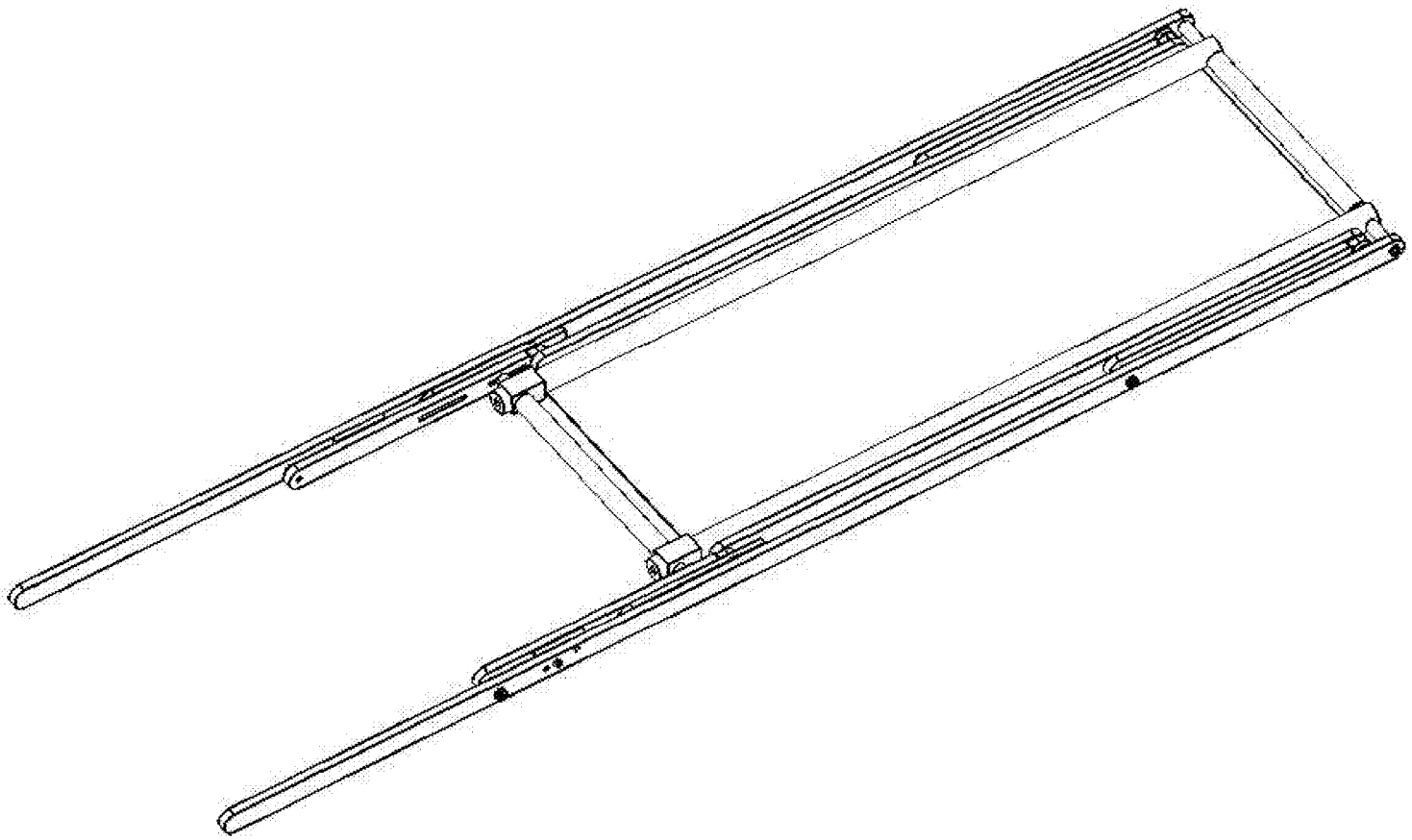
FIG. 29 is a perspective view of disclosed components

FIG. 29 depicts a system in a folded position.

Figure 30:
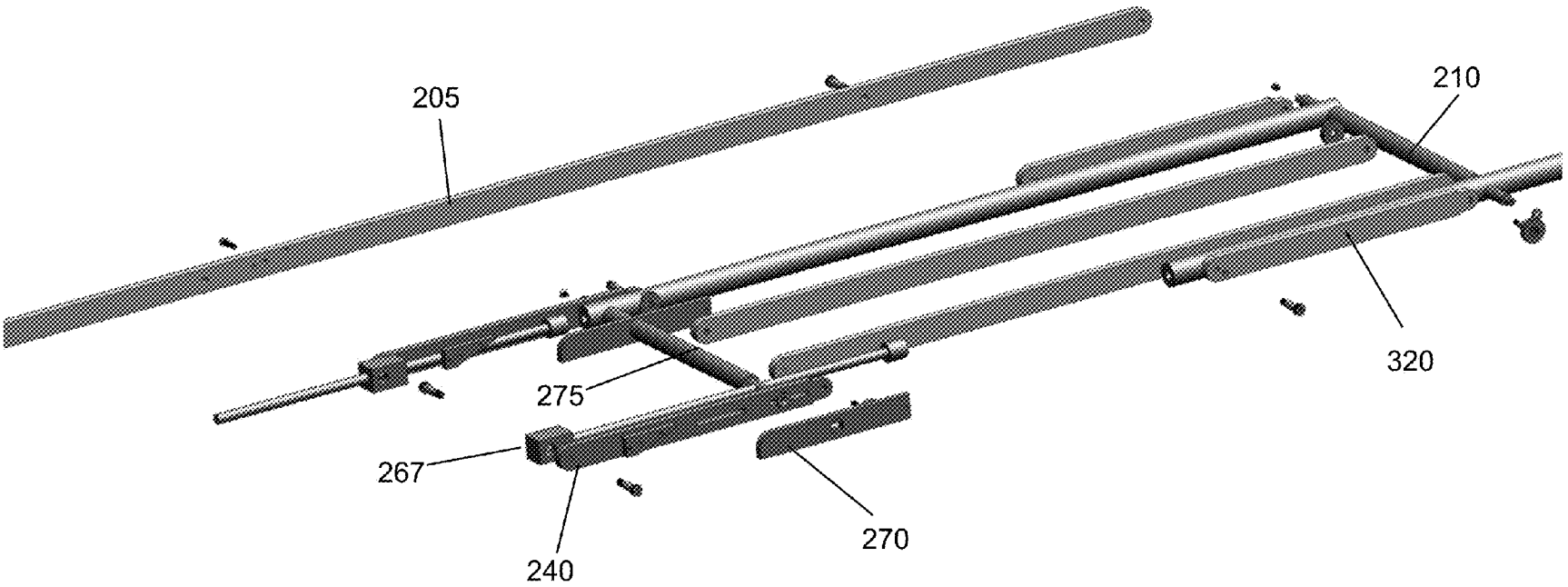
FIG. 30 is an exploded view of disclosed components in a flat position

FIG. 30 depicts a system in a folded position with components in an exploded position.

In moving the lower cross bar, a cylinder 265 may contain a piston 265, and the piston may move out of the cylinder further separating the lower cross bar from the upper cross bar. The piston 265 may be connected to a cylinder rod clevis 267 and the lower cross bar may be connected to the cylinder rod clevis 267.

The expansion, separation or movement of the upper cross bar and lower cross bar may occur by any means. The piston may be driven or controlled by use of gas, air pressure, fluid pressure or other forces, including such forces directed to the cylinder.

FIG. 31 depicts disclosed components in a flat or folded position.

Figure 32:
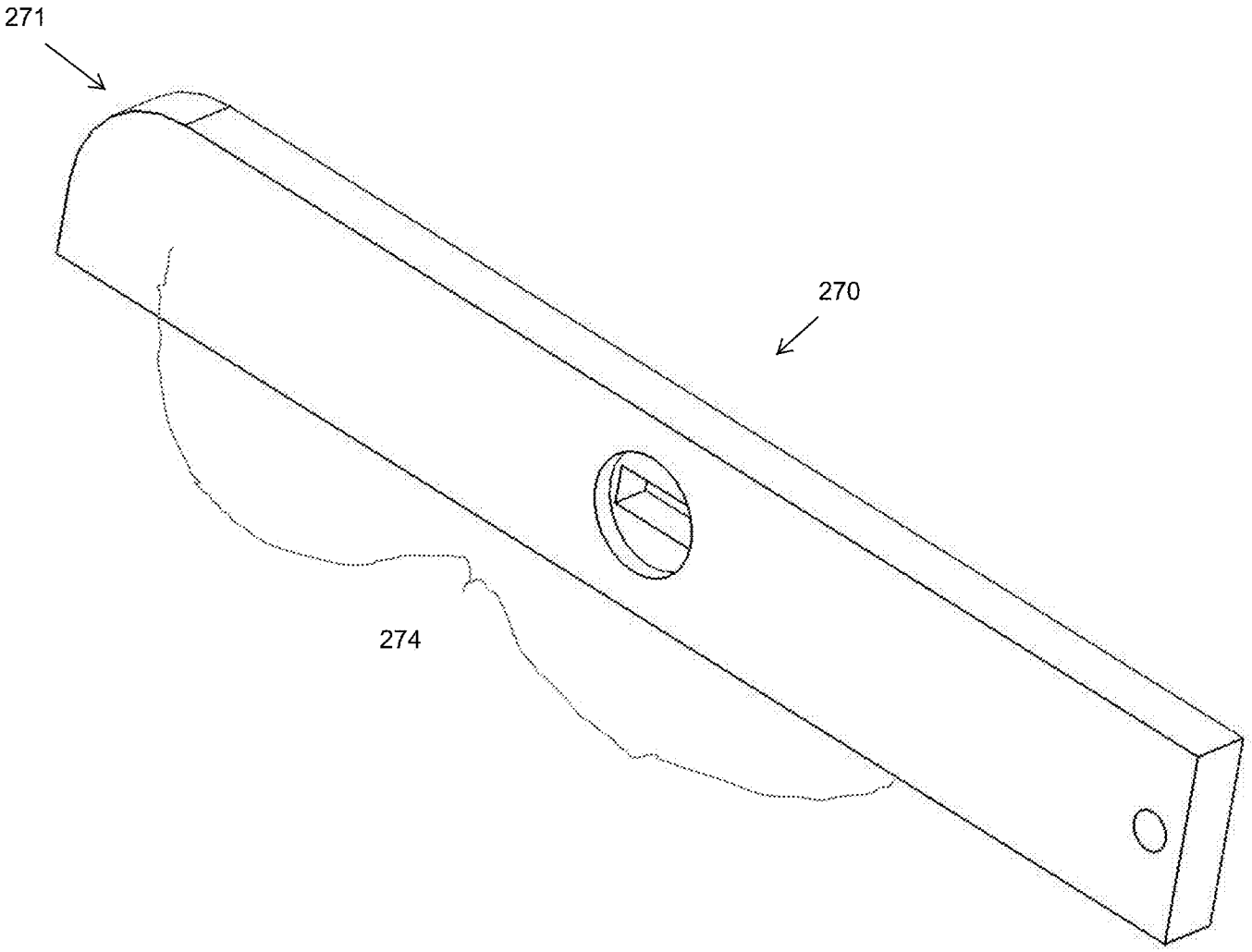
FIG. 32 is a perspective view of a wedge bar

FIG. 32 depicts a wedge bar 270 comprising a longitudinal body 274, a first end comprising a cambered edge 271.

Figure 33:
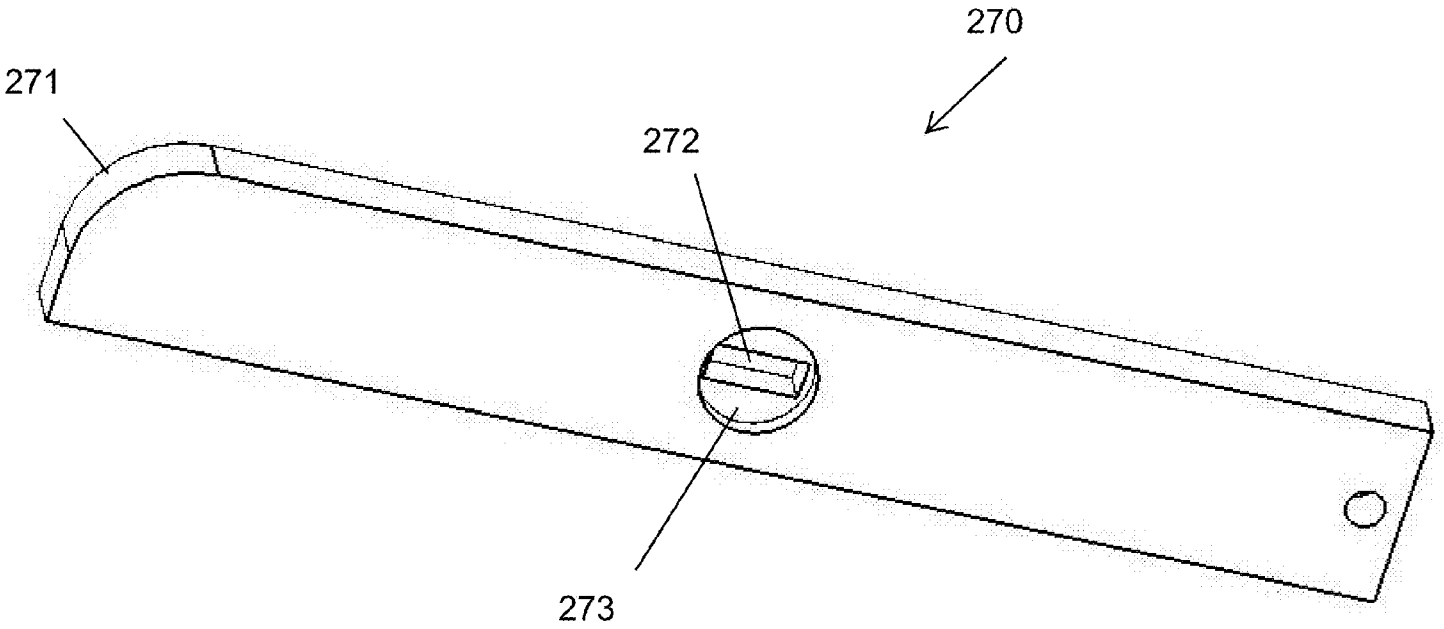
FIG. 33 is a perspective view of a wedge bar

FIG. 33 depicts a wedge bar 270 comprising a first end having a cambered edge, a longitudinal body defining a first void 272, with the longitudinal body further defining a indent void 272 or indent area, sometimes used to retain a wedge washer or to otherwise retain a lower cross bar.

Figure 34:
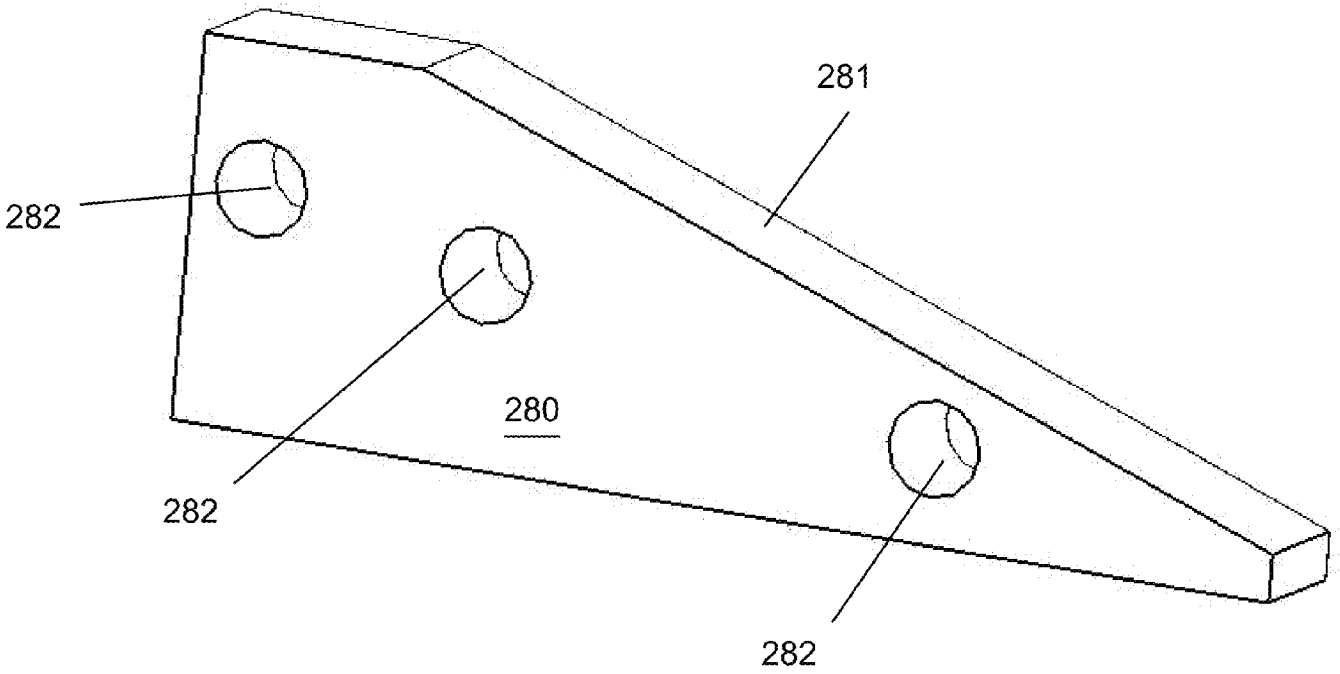
FIG. 34 is a perspective view of a wedge

FIG. 34 depicts a wedge 280, the wedge sometimes comprising angled edge 281, the angled edge comporting to or interfacing with the cambered edge of a wedge bar. The wedge 280 defining one or more voids 282.

Figure 35:
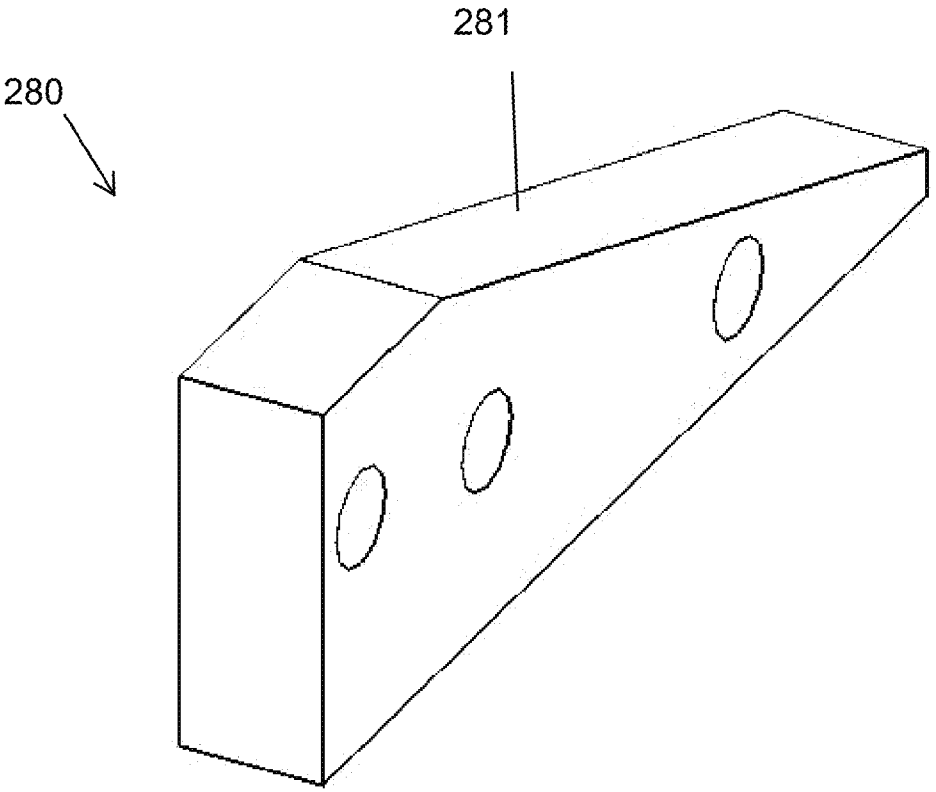
FIG. 35 is a perspective view of a wedge

FIG. 35 depicts a perspective view of a wedge 280.

Figure 36:
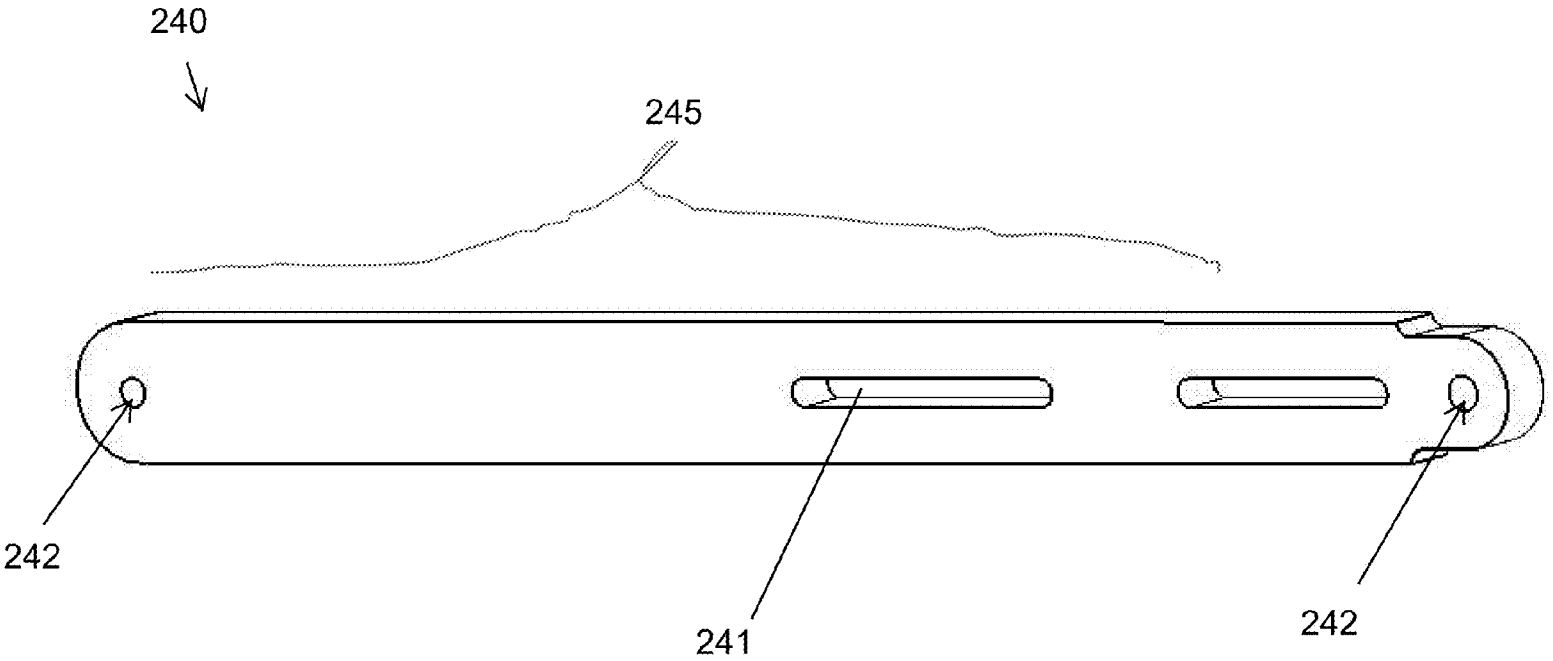
FIG. 36 is a perspective view of a wheelie bar

FIG. 36 depicts a perspective view of a wheelie bar 240 comprising a longitudinal body 245 defining one or more longitudinal voids 241, a longitudinal void may retain a lower cross bar.

Figure 37:
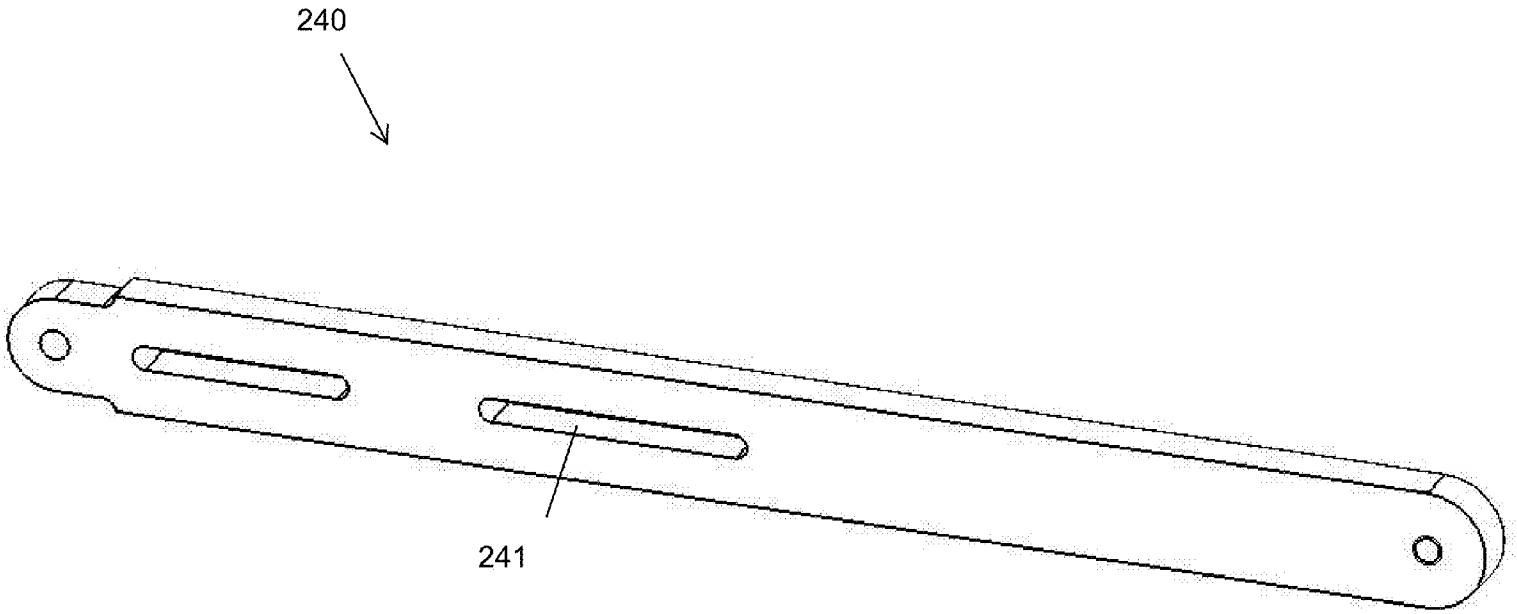
FIG. 37 is a perspective view of a wheelie bar

FIG. 37 depicts a perspective view of a wheelie bar 240.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A lift comprising:

a) a top bar (205) fixedly attached to a wedge (280) and the top bar pivotally attached to a first end of a wheelie bar (240), the wheelie bar comprising a longitudinal body (245) with the longitudinal body defining a longitudinal void (241) the longitudinal void of the wheelie bar retaining a lower cross bar (275), allowing the lower cross bar to slide within the longitudinal void of the wheelie bar;

b) the wheelie bar comprising a second end pivotally attached to a bottom bar (440); and c) a wedge bar (270) attached to a distal end of the lower cross bar, the wedge bar comprising a first end having a cambered edge (271).

2. The lift of claim 1 further comprising at least one piston attached to the lower cross bar.

3. The lift of claim 1 wherein the wedge comprises an angled edge (281), the angled edge comporting to the cambered edge of the wedge bar.

4. The lift of claim 2 further comprising a cylinder rod clevis (267) attached to the lower cross bar and the piston.

5. The lift of claim 2 further comprising a cylinder (260) attached to the piston.

6. The lift of claim 2 wherein the piston is attached to an upper cross bar (210).

7. The lift of claim 1 wherein one or more wheels are attached to the bottom bar.

8. The lift of claim 1 wherein a skid plate (450) is attached to a bottom bar.

* * * * *